US011686554B2

(12) United States Patent
Lee et al.

(10) Patent No.: US 11,686,554 B2
(45) Date of Patent: Jun. 27, 2023

(54) FOLDABLE DOT SIGHT DEVICE

(71) Applicants: Bo Sun Jeung, Bucheon-si (KR); Ik Seon Jung, Bucheon-si (KR)

(72) Inventors: Dong Hee Lee, Seongnam-Si (KR); In Jung, Bucheon-Si (KR); Ik Seon Jung, Bucheon-Si (KR); Bo Sun Jeung, Bucheon-si (KR)

(73) Assignees: Bo Sun Jeung, Bucheon-si (KR); Ik Seon Jung, Bucheon-si (KR)

( * ) Notice: Subject to any disclaimer, the term of this patent is extended or adjusted under 35 U.S.C. 154(b) by 24 days.

(21) Appl. No.: 17/397,055

(22) Filed: Aug. 9, 2021

(65) Prior Publication Data

US 2022/0325981 A1 Oct. 13, 2022

(30) Foreign Application Priority Data

Apr. 8, 2021 (KR) ..... 10-2021-0045700

(51) Int. Cl.
*F41G 1/30* (2006.01)

(52) U.S. Cl.
CPC ..... *F41G 1/30* (2013.01)

(58) Field of Classification Search
CPC ..... F41G 1/30
USPC ..... 42/113
See application file for complete search history.

(56) References Cited

U.S. PATENT DOCUMENTS

| | | | | |
|---|---|---|---|---|
| 5,577,326 | A * | 11/1996 | Montelin | F41G 1/32 42/123 |
| 7,552,558 | B1 * | 6/2009 | Ballard | F41G 1/40 356/255 |
| 7,921,591 | B1 * | 4/2011 | Adcock | F41G 1/30 42/145 |
| 9,696,114 | B1 * | 7/2017 | Cabrera | F41G 1/10 |
| 9,823,044 | B1 * | 11/2017 | Cabrera | F41G 1/17 |
| 9,869,526 | B1 * | 1/2018 | Cheng | F41G 1/30 |
| 10,101,121 | B2 | 10/2018 | Cabrera et al. | |
| 10,746,504 | B2 | 8/2020 | Cabrera et al. | |
| 10,883,797 | B2 | 1/2021 | Cabrera et al. | |
| 10,890,414 | B2 | 1/2021 | Cabrera et al. | |
| 11,231,251 | B2 * | 1/2022 | Cabrera | F41G 1/10 |
| 2014/0150325 | A1 * | 6/2014 | Keng | F41G 11/003 42/118 |

* cited by examiner

*Primary Examiner* — Samir Abdosh
(74) *Attorney, Agent, or Firm* — Baker & McKenzie LLP

(57) ABSTRACT

A foldable dot sight device is provided that includes a body capable of being assembled into a firearm. A dot generator is disposed on the body, and is capable of generating a dot for aiming at a target. A reflective mirror is provided, which transmits an image of a target toward the user and reflects the dot generated by the dot generator. A housing is connected to the reflective mirror. A protective cover includes a sliding guide rotatably connected to the body and rotates the housing in a folding or unfolding direction according to a rotational position.

29 Claims, 30 Drawing Sheets

(a)

(b)

(a)

(b)

FOLDABLE DOT SIGHT DEVICE

CROSS-REFERENCE TO RELATED APPLICATION

This application claims priority to and the benefit of Korean Patent Application No. 10-2021-0045700 with a priority date of Apr. 8, 2021, the contents of which is incorporated herein by reference.

BACKGROUND

In general, a dot sight device may be coupled to one side of the firearm to accurately aim a target. Especially in the case of pistols, aiming is achieved by aligning the sightline between the rear sight and the front sight (i.e., iron sight or mechanical sight). The speed and accuracy in acquiring a target are extremely important factors in firing a pistol.

However, the disadvantages of the traditional mechanical sight are that it is difficult to acquire a target even with slight vibration or tremors. As such, the traditional mechanical sights have disadvantages in situations where quick acquisition of targets is desired, for example, in a close-range shooting. Also, as the shooter is focused on aligning the line of front and rear sights rather than the target itself, the shooter's field of view may be narrowed.

To overcome the cumbersome alignment of the mechanical sight and to increase the shooting accuracy, optical sights had been proposed. However, since the optical sight uses a telescopic reflective mirror, if the magnification of the reflector is increased, it responds sensitively to small vibrations as well, which makes it difficult to aim quickly.

To overcome the problems of telescopic optical sights, a dot sight device has been proposed that employs a reflective mirror with almost no magnification and uses only an aiming point while eliminating a complicated aiming line.

The optical dot sight allows simple and quick acquisition of the target which is useful in urgent situations or close-range shooting. In other words, it takes almost no time to acquire a target when using the optical dot sight device, as all the shooter has to do for aiming is to quickly point the lighted dot to the target. The optical dot sight device also allows securing a wider field of view for the shooter.

FIG. 1 of the appended drawings is a diagram of a side view showing a conventional dot sight is installed in a pistol. In more detail, a lighted dot made from an LED light source (3*a*) located inside the optical dot sight device is reflected by a reflective mirror (3*b*) and enters the shooter's eye in parallel, and the lighted dot is also parallel with respect to the barrel's bullet firing axis.

Here, a dial for adjusting the lighted dot vertically (3*c*) and a dial for adjusting the lighted dot horizontally (3*d*) are provided so that the parallelism of the optical dot sight device 3 and the bullet firing axis of the barrel can be matched.

Generally, pistols are used for close-range shooting of about 50 meters. Since the shooting distance for pistols is short, there is generally a higher aiming accuracy if the distance between the barrel of the pistol (1) and the dot sight device (3) is closer. In the conventional dot sight device (3) as depicted in FIG. 1, a base (2) is required for affixing the dot sight (3) to the pistol (1), and, therefore, the distance between the dot sight device (3) and the pistol (1) cannot be narrowed, which negatively affects the aiming accuracy.

In addition, when the dot sight device is attached to the pistol as shown in FIG. 1, the overall size of the pistol becomes significantly larger, making it inconvenient to carry and store. Also, the increased size of the pistol may cause many other problems such as difficulty in taking the pistol out of the holster.

SUMMARY OF INVENTION

Accordingly, an object of the present invention is to provide a foldable dot sight device to be attached to a firearm such as a pistol. When attached to a pistol, the foldable dot sight device will not increase the overall size of the pistol significantly, and therefore, the pistol with the foldable dot sight may be easily carried, stored, and used. In addition, when the protective cover for folding the aiming unit is fully unfolded, the protective cover is separated from the aiming unit, and this separation can prevent the aiming unit from moving arbitrarily due to an external force acting on the protective cover during the aiming process.

The present invention relates to a foldable dot sight device, and more particularly, to a dot sight device that has a foldable aiming unit for easy use, portability, and storage. During the aiming process, the aiming unit of the foldable dot sight device can move arbitrarily as the external force can act on the protective cover. The present invention also relates to a foldable dot sight device that can prevent the aiming unit from arbitrarily moving during the aiming process, as the protective cover is separated from the aiming unit when the protective cover is fully opened.

According to the present invention, there is provided a foldable dot sight having a body to be assembled to a firearm, a dot generator disposed on the body for providing a dot for aiming at a target, a reflective mirror that transmits the image of the target in front toward the shooter and reflects the dot provided from the dot generator toward the shooter, an aiming unit having a housing rotatably connected to the body when the reflective mirror is fixed in a position, and a protective cover rotatably connected to the body portion and having a sliding guide for rotating the housing in a folding or unfolding direction according to the rotational positions.

Here, it is preferable that the unfolding position of the protective cover is set to a position where the sliding guide is separated from the housing by additional rotation of the protective cover after the housing is moved to the unfolded position.

In addition, the housing preferably includes a first guide protrusion that is in contact with the sliding guide while the protective cover is rotating and is separated from the sliding guide after the protective cover is completely rotated in the unfolding direction.

In addition, it is preferable that the housing further includes a second guide protrusion that is pressed by the protective cover and enters the first guide protrusion into the sliding guide when the protective cover rotates in a folding direction from a fully unfolded state.

In addition, it is preferable that the protective cover includes a rear sight capable of aligning with a front sight disposed in front of the barrel to aim at a target, and the rear sight is disposed preferably in the aiming position when the protective cover rotated to the folded position.

In addition, the protective cover preferably includes a stopper capable of limiting further rotation by contacting the firearm in an unfolded position of the protective cover.

In addition, it is preferable that either the protective cover or the body includes a stopper that can guide the unfolding position of the protective cover.

In addition, it is preferable that the stopper is provided in each of the body and the protective cover and includes a permanent magnet and a magnetic body that is attached by magnetic force in the unfolded position of the protective cover.

In addition, it is preferable to further include an elastic member for elastically supporting the protective cover in the unfolding direction.

In addition, the firearm includes a cover locking unit capable of fixing the protective cover in a folded position.

In addition, the protective cover includes sidewalls surrounding both sides of the body, a connecting bridge connecting the upper part of the sidewalls, and a pair of pivot shafts respectively formed on inner side surfaces of each sidewall and facing each other, and a pair of pivot grooves formed on the body such that the pivot shafts are axially rotatably inserted and supported by the pivot grooves.

In addition, each pivot shaft includes a pair of support wings extending in a radial direction from the outer circumferential surface, and the body includes a connecting passage connecting the outer surface of the body and the pivot groove so that the pivot shaft can be inserted into the pivot groove. The body further includes circular receiving grooves so that each circular receiving groove is coaxial with each pivot groove and capable of rotatably accommodating the support wings. The outer edge of the pair of support wings forming a circular arc corresponding to the inner circumferential surface of the receiving groove is preferable.

In addition, it is preferable that the pair of support wings and the circular receiving groove are provided in plurality, and it is also preferable that support wings and the circular receiving grooves are spaced apart from each other in accordance with the axial direction of the pivot shaft.

In addition, it is preferable that the width of the support wing is set to be smaller than the width of the connecting passage and that the extension direction of the support wing is set not to coincide with the connecting passage when the protective cover is rotated to fold or unfold the housing.

In addition, it is preferable that the body includes a support for guiding an unfolding position of the housing, and the housing is elastically supported in an unfolding direction by an elastic member.

In addition, it is preferable that a permanent magnet is disposed on the support, and a magnetic body capable of being attached to the permanent magnet is provided at a position corresponding to the permanent magnet of the housing.

In addition, it is preferable that the body include a zeroing unit disposed inside the protective cover on the body, and the zeroing unit is capable of adjusting the position of the dot generator left and right and up and down.

In addition, it is preferable that the zeroing unit includes a support for supporting the dot generator, a left/right moving block vertically and slidably assembled to the support, a left/right adjustment unit axially and rotatably supported on the body, an up/down moving block laterally and slidably assembled to the support, and an up/down adjustment unit is axially and rotatably supported on the body.

In addition, it is preferable that the zeroing unit further includes a spring that is disposed between the body and the up/down moving block such that the spring elastically supports the up/down moving block in an upward or downward direction.

In addition, it is preferable that the zeroing unit further includes a pressure support unit for preventing any rotation of the left/right adjustment unit or the up/down adjustment unit.

In addition, it is preferable that the sidewall of the protective cover is provided with a through-hole through which the left/right adjustment unit can be exposed when the protective cover is fully unfolded.

In addition, it is preferable that the pressure support unit includes a pressure head disposed on the side of the left/right adjustment unit or up/down adjustment unit, an elastic member elastically supporting the pressure head, and an adjustment screw screwed to the body that is capable of supporting the rear portion of the elastic member.

In addition, it is preferable that the body is detachably assembled in a seating groove provided on the firearm.

In addition, it is preferable that the firearm is provided with a body fastener for fastening the body assembled in the seating groove.

In addition, it is preferable that the seating groove is comprised of an upper groove recessed from the upper surface of the firearm and a side surface groove recessed from each side of the firearm, respectively, and it is also preferable that the lower portion of the body is inserted and supported in the upper groove and the side surface groove of the seating groove, respectively, such that the forward and backward movement and the left and right movement of the body is restricted.

In addition, it is preferable that the body fastener includes a fastening block assembled in a direction crossing the firearm in the side surface groove, and the body is engaged with the fastening block to limit movement in the upward direction.

In addition, it is preferable that the body fastener includes a fastening ball in contact with the side surface of the fastening block, and the fastening ball includes a spring for elastically supporting the fastening ball toward the fastening block, and an insertion groove disposed on the side of the fastening block such that the fastening ball can be inserted and supported.

According to the present invention, there is provided a foldable dot sight that is convenient to use and easy to carry and store since the aiming unit for aiming a target can be folded. It is also possible to provide a foldable dot sight that can prevent an aiming unit from arbitrarily moving by an external force acting on a protective cover, as the protective cover, in a fully unfolded state, is separated from the aiming unit.

DETAILED DESCRIPTION OF THE EMBODIMENT(S)

Figure 1:
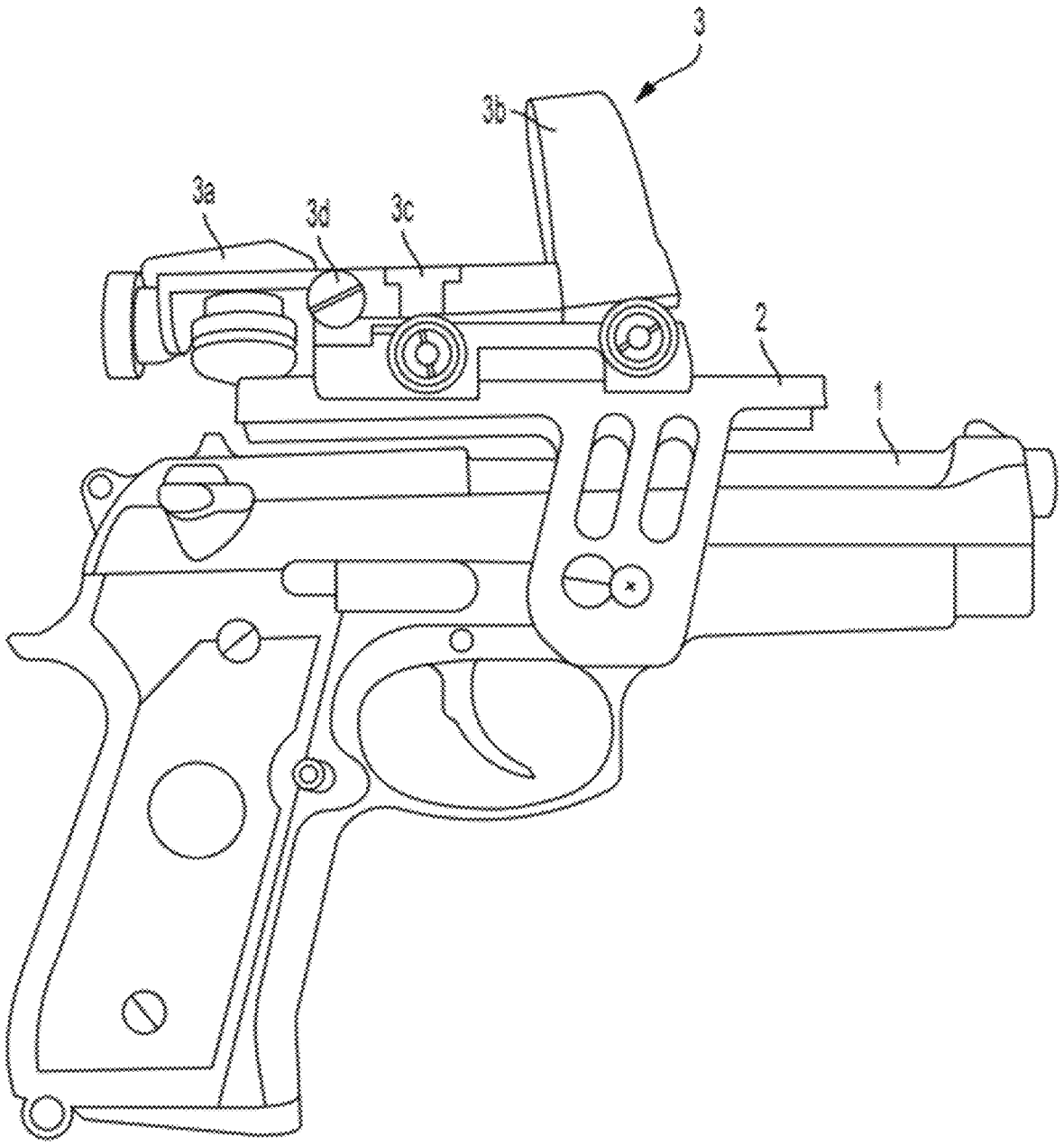
FIG. 1 PRIOR ART
FIG. 1 is a picture showing a dot sight is installed in a conventional pistol in a related art.

In various embodiments, components having the same configuration will be typically described in the first embodiment using the same reference numerals, and configurations different from the first embodiment will be described in other embodiments.

Hereinafter, the first embodiments of the present invention will be described in detail with reference to the appended drawings.

Figure 2:
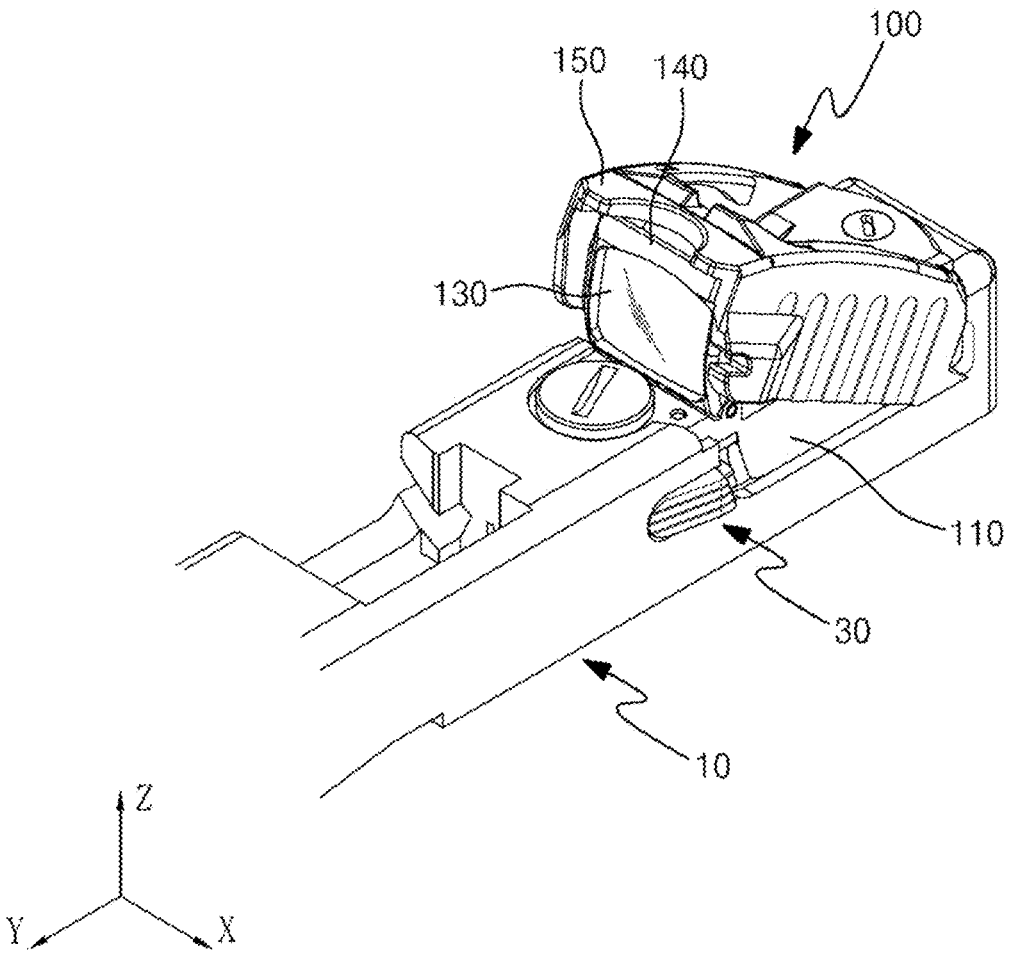
FIGS. 2 and 3 are diagrams showing a foldable dot sight device in which a protective cover is opened according to an embodiment of the present invention.
Figure 3:
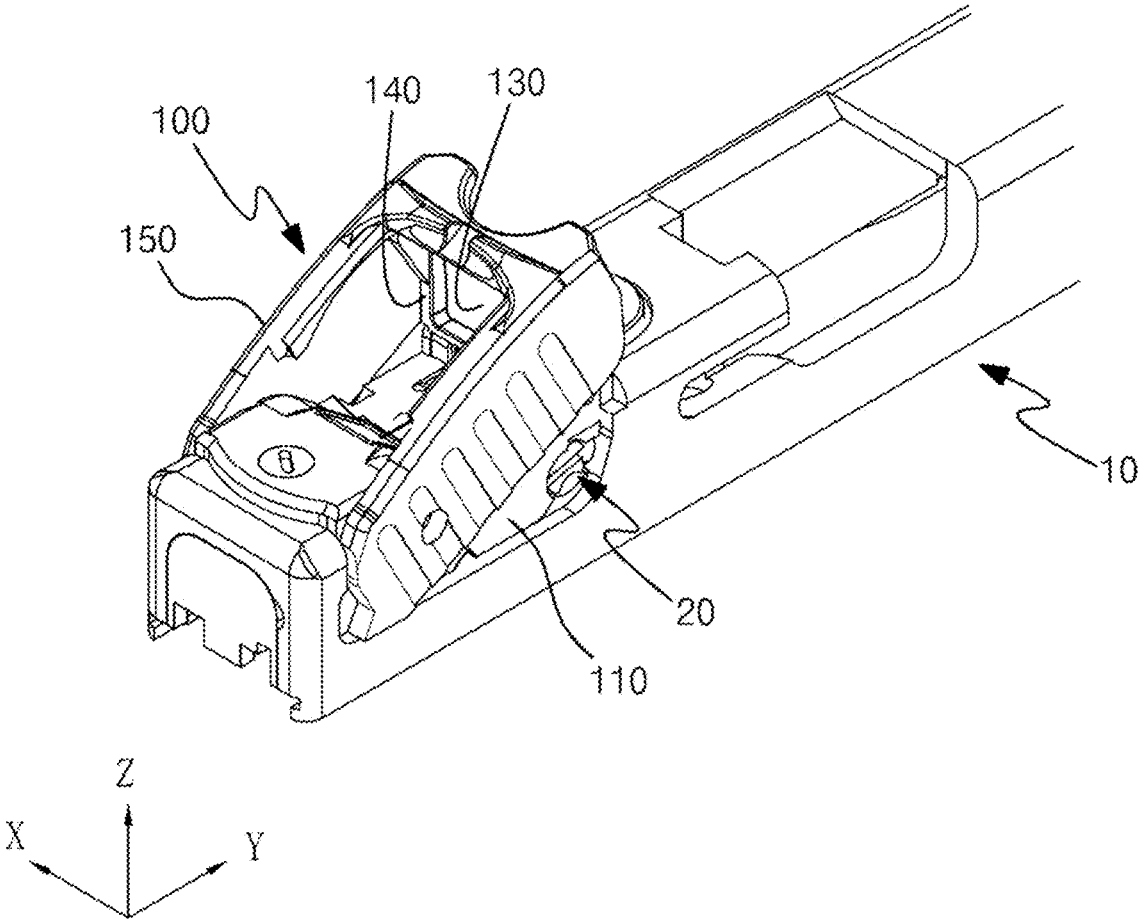
Figure 4:
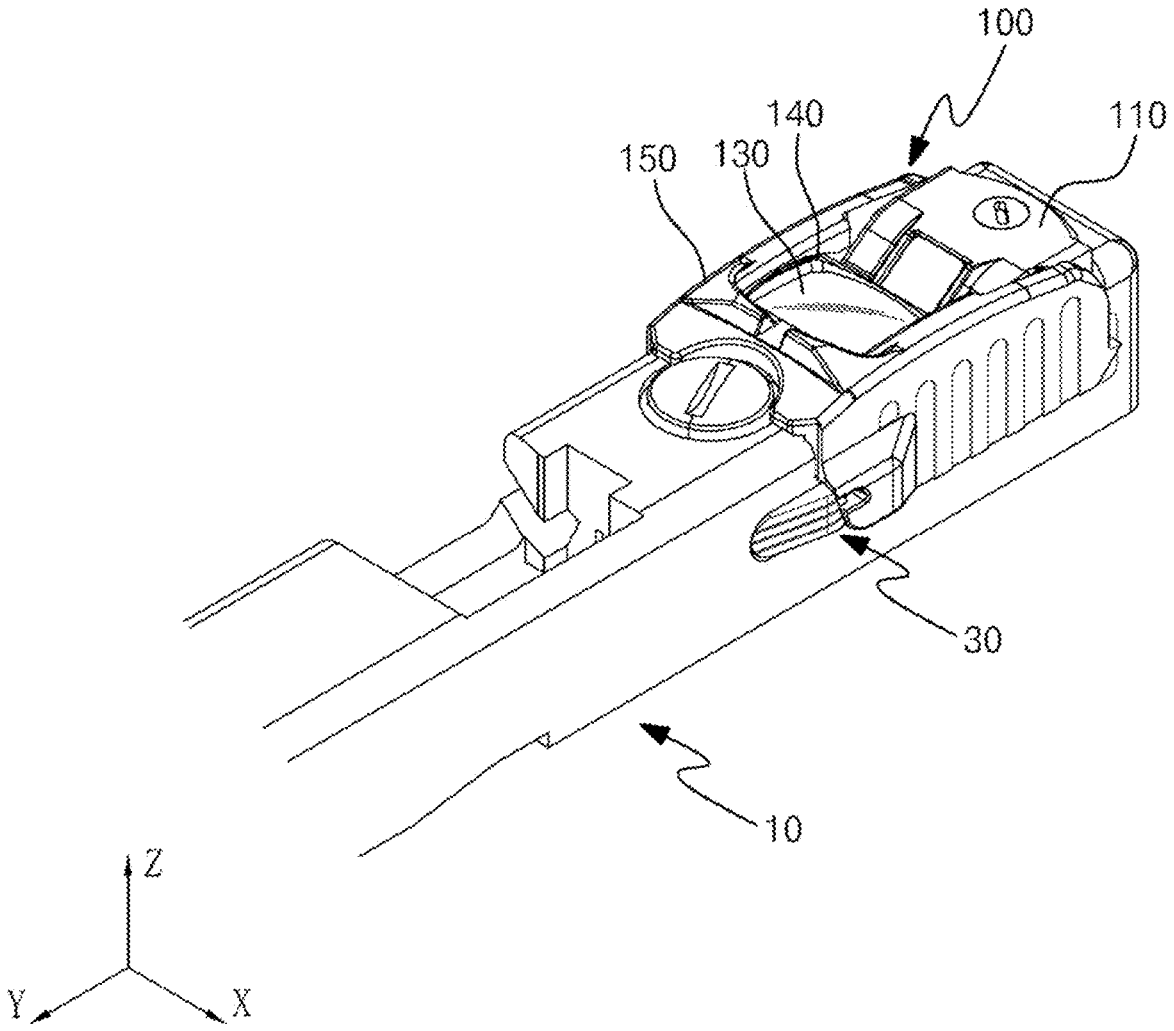
FIGS. 4 and 5 are diagrams showing a foldable dot sight device in which a protective cover is closed according to an embodiment of the present invention.
Figure 5:
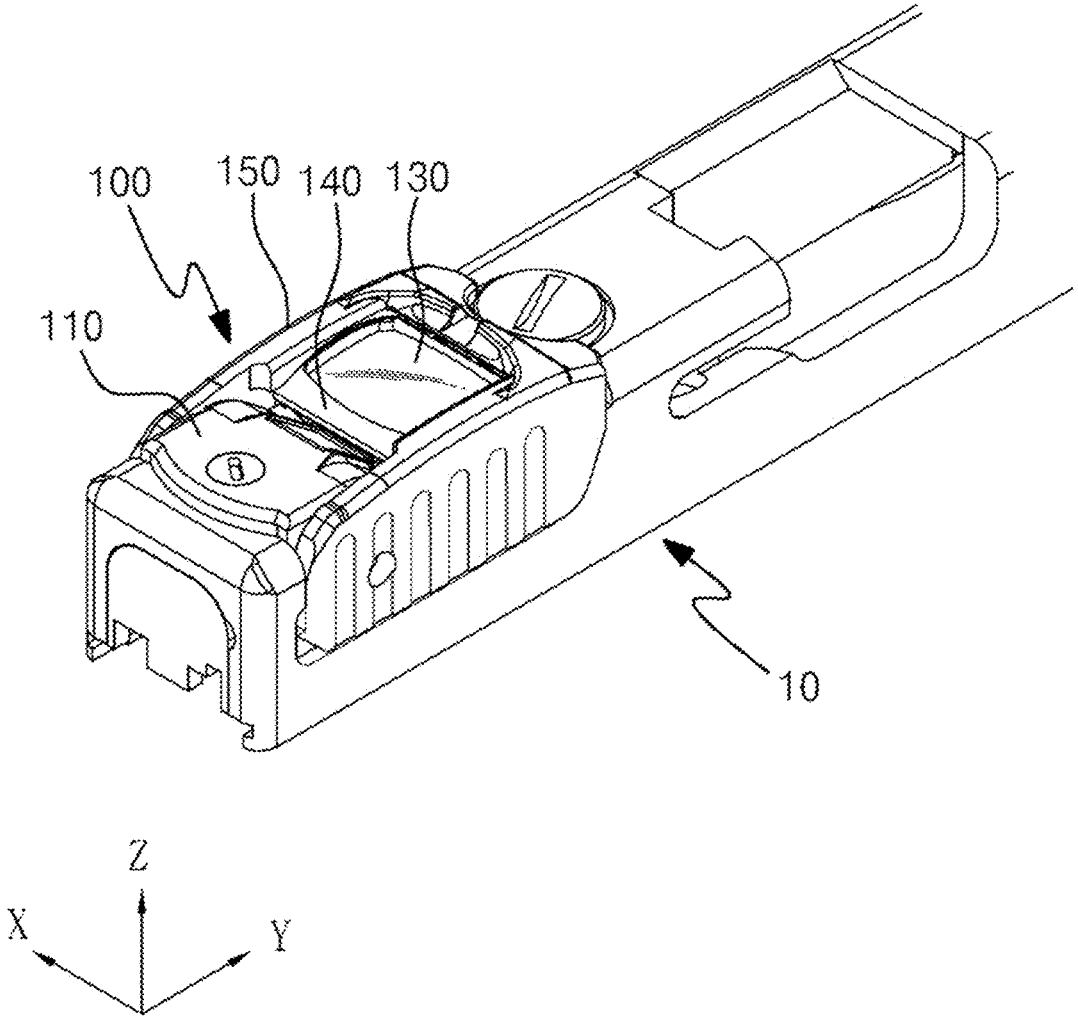
Figure 6:
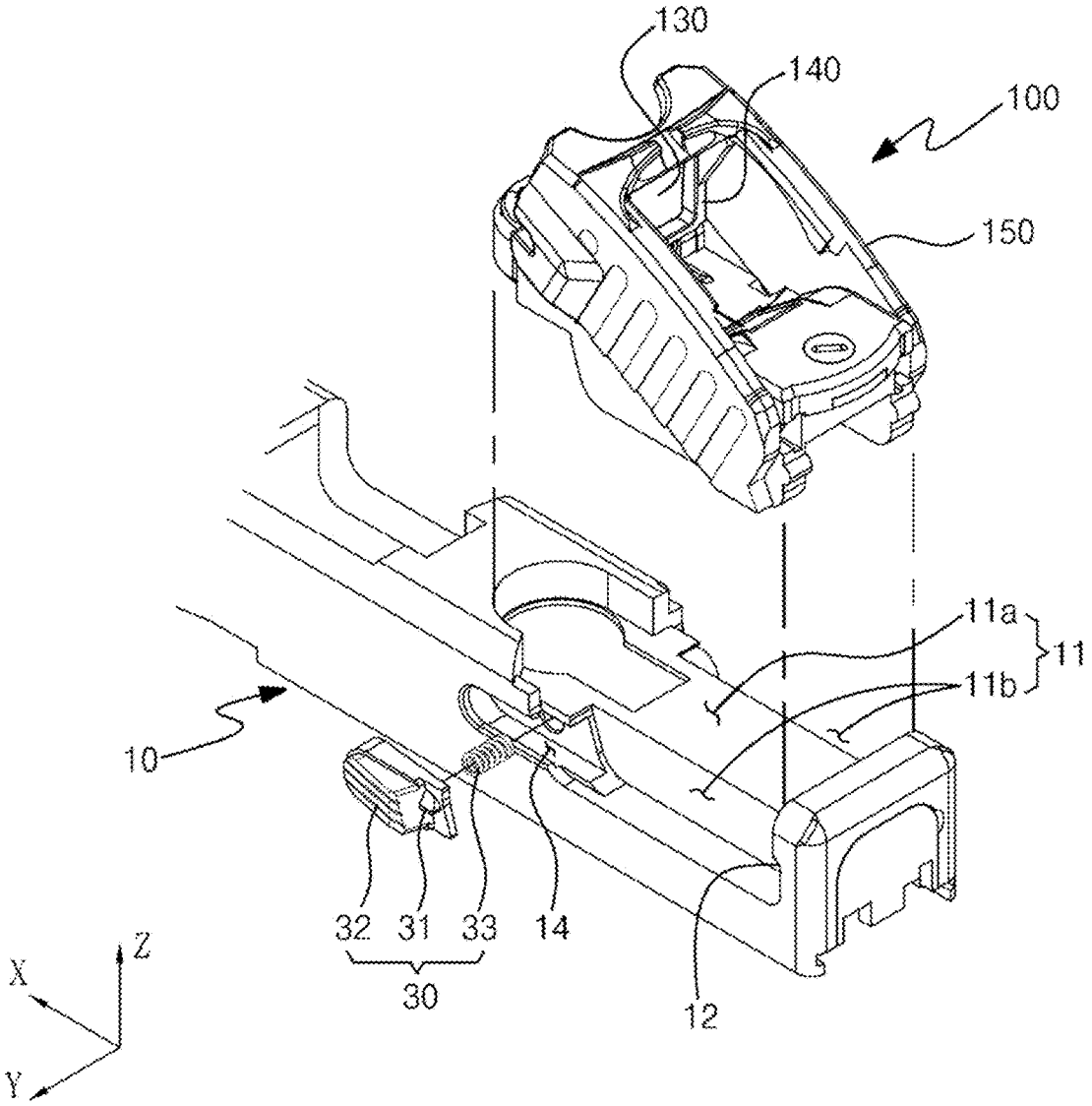
FIGS. 6 and 7 are diagrams showing a foldable dot sight device that is separated from the firearm according to an embodiment of the present invention.
Figure 7:
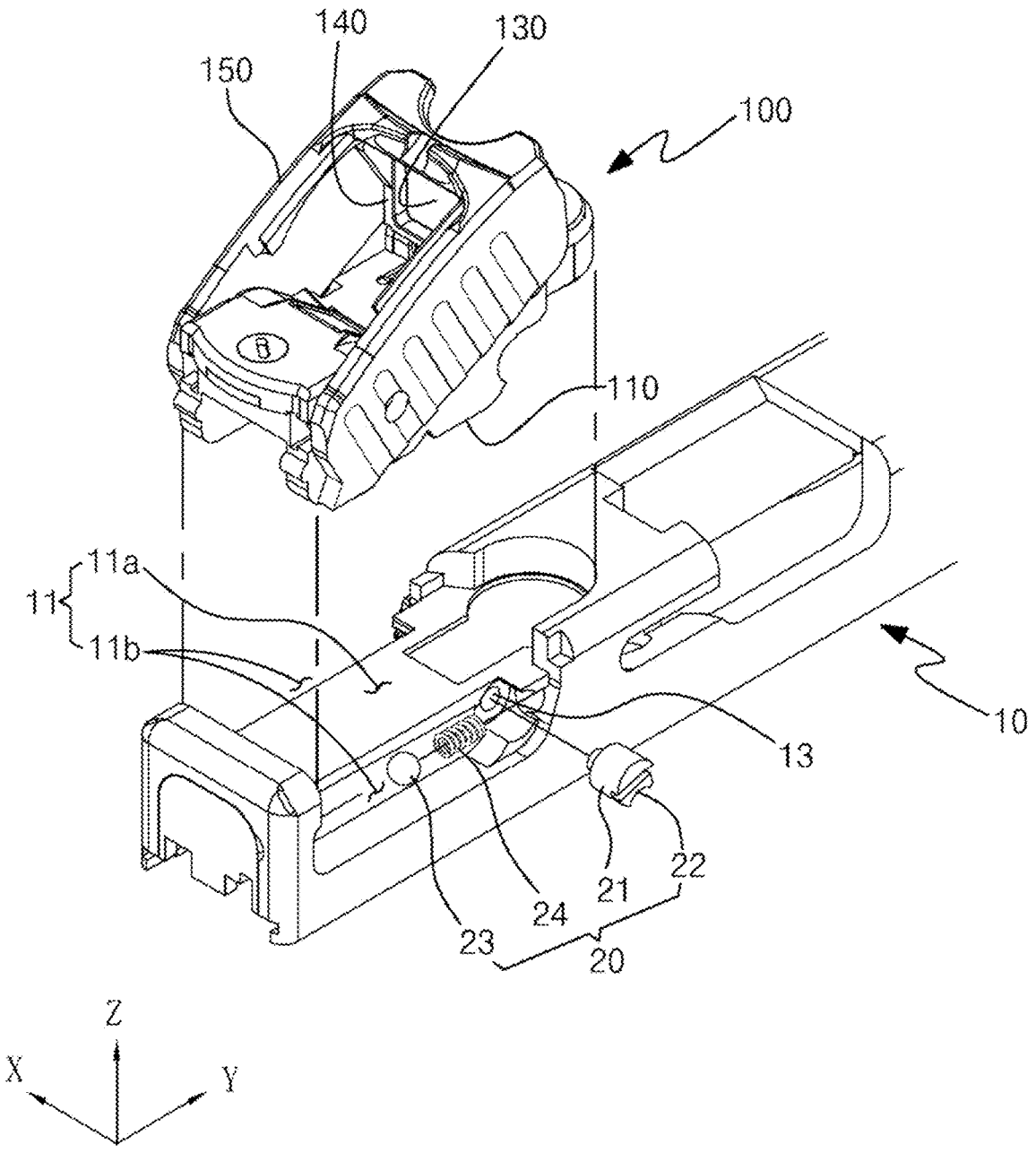
Figure 8:
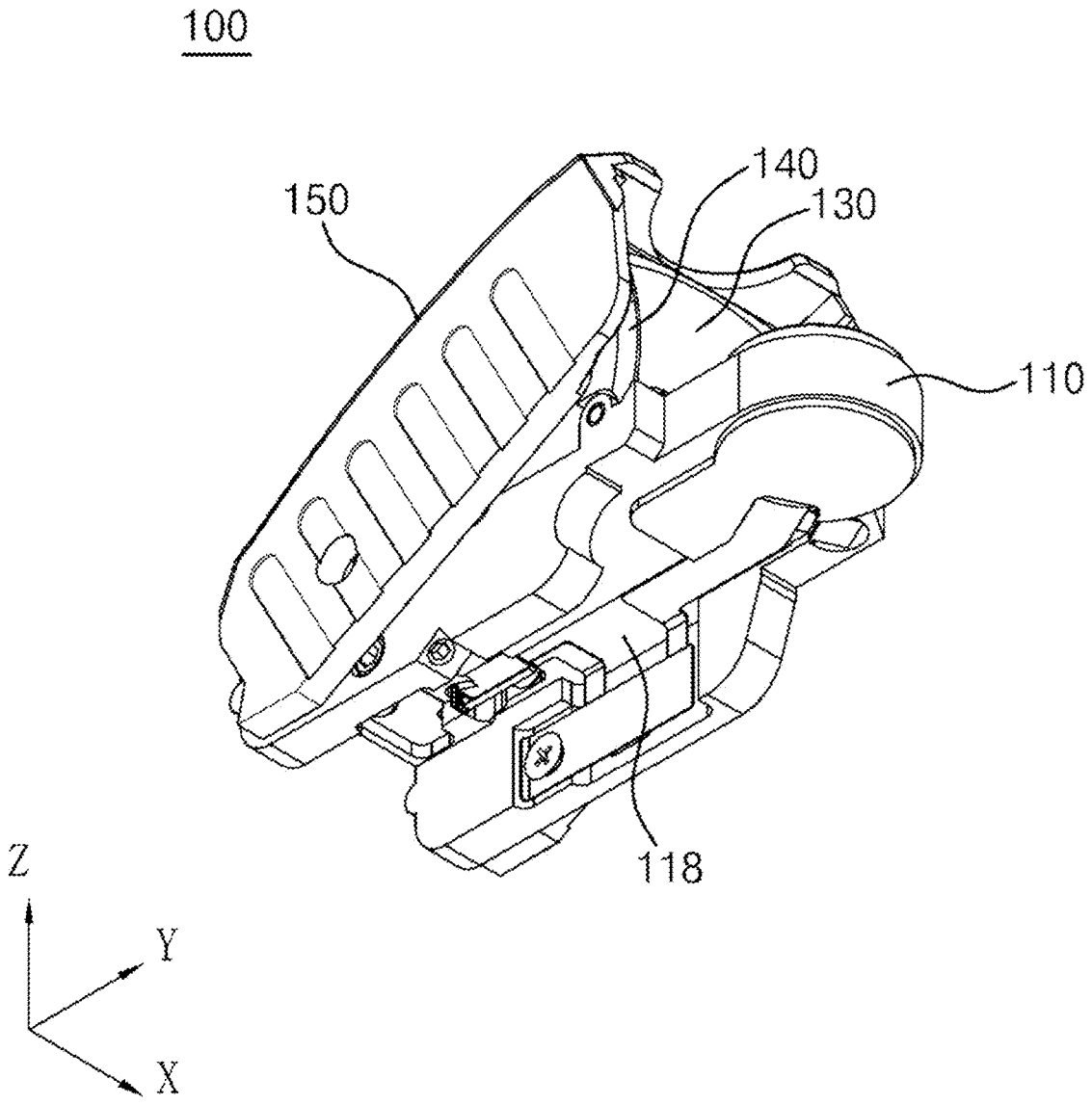
FIG. 8 is a diagram showing a bottom perspective view of a foldable dot sight device according to an embodiment of the present invention.
Figure 9:
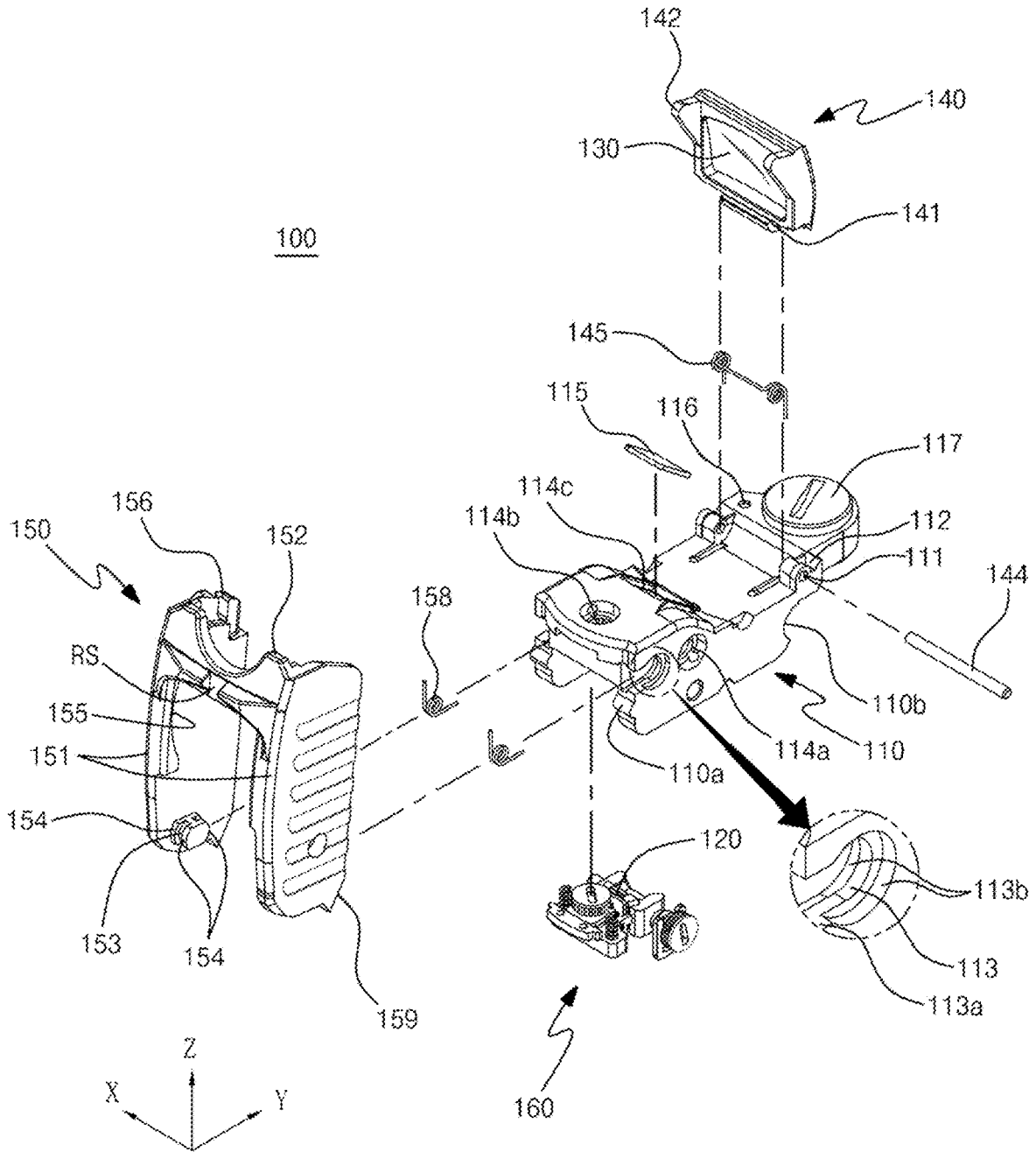
FIGS. 9 and 10 are diagrams showing exploded perspective views of a foldable dot sight device according to an embodiment of the present invention.
Figure 10:
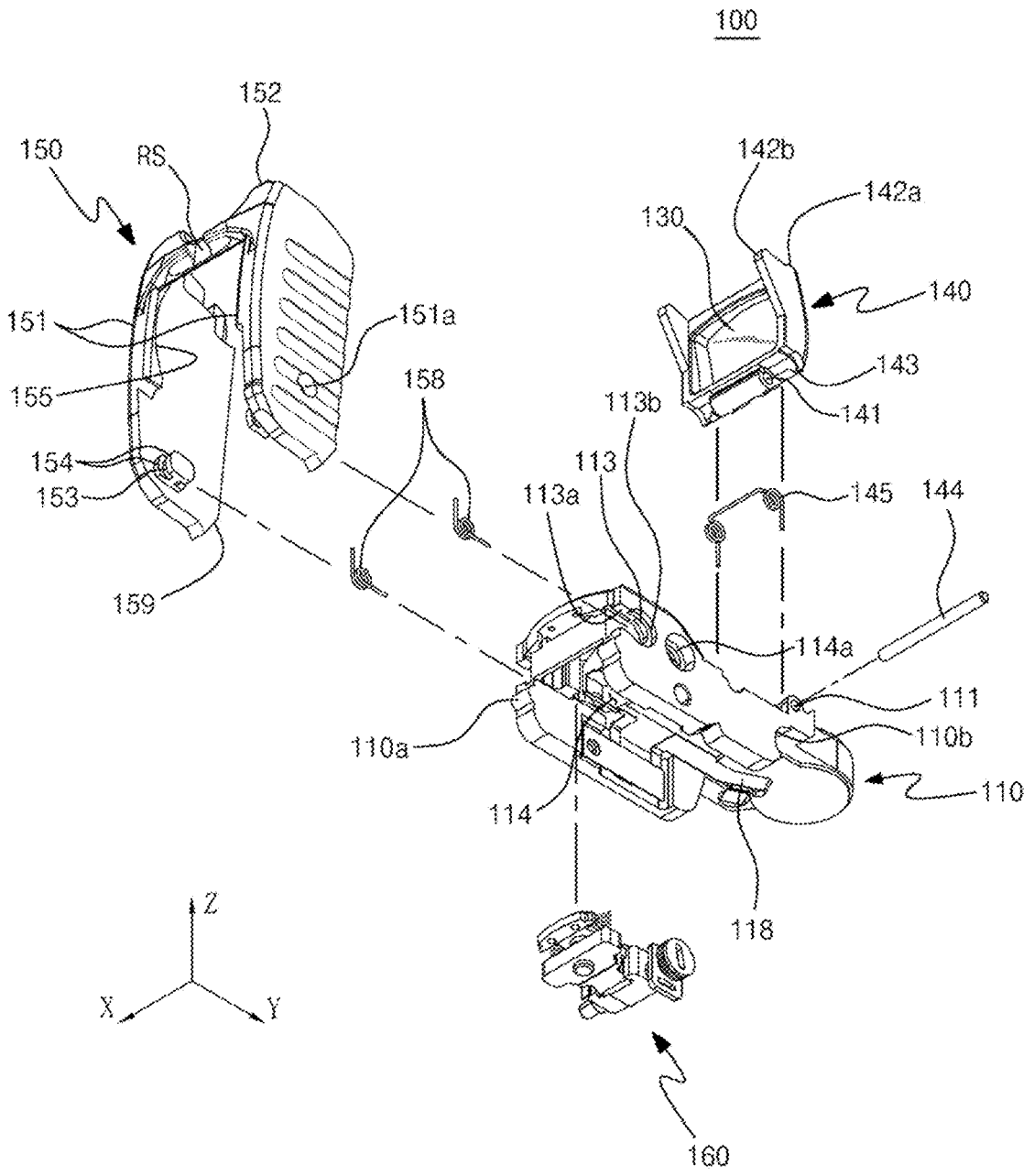
Figure 11:
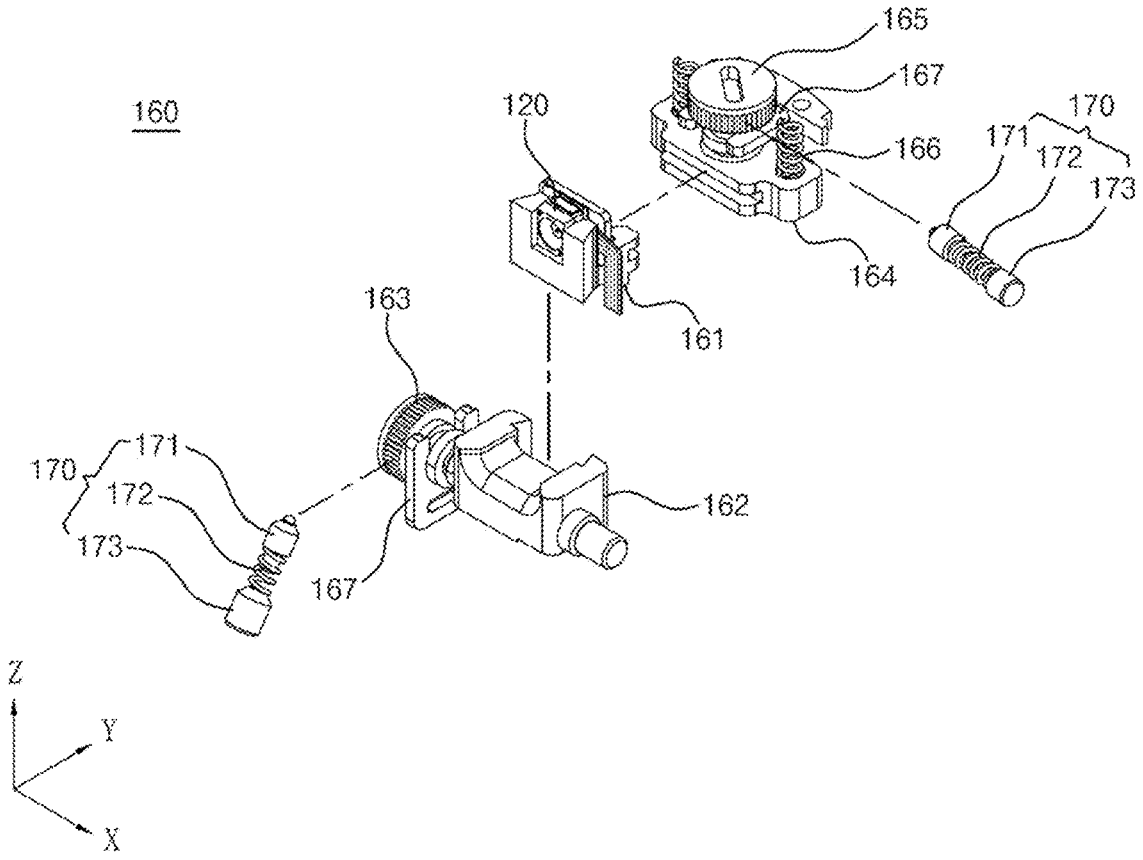
FIGS. 11 and 12 are diagrams showing exploded perspective views of a zeroing unit of a foldable dot sight device according to an embodiment of the present invention.
Figure 12:
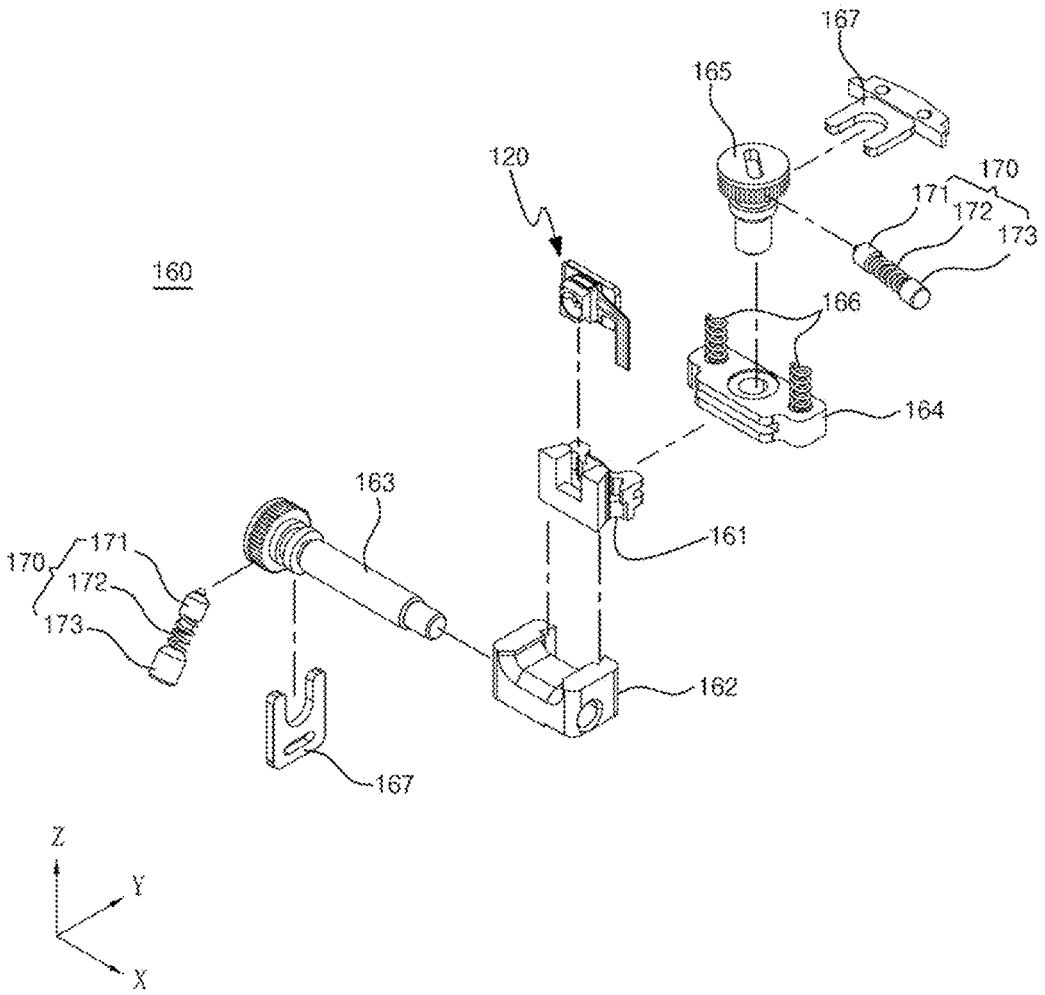
Figure 13:
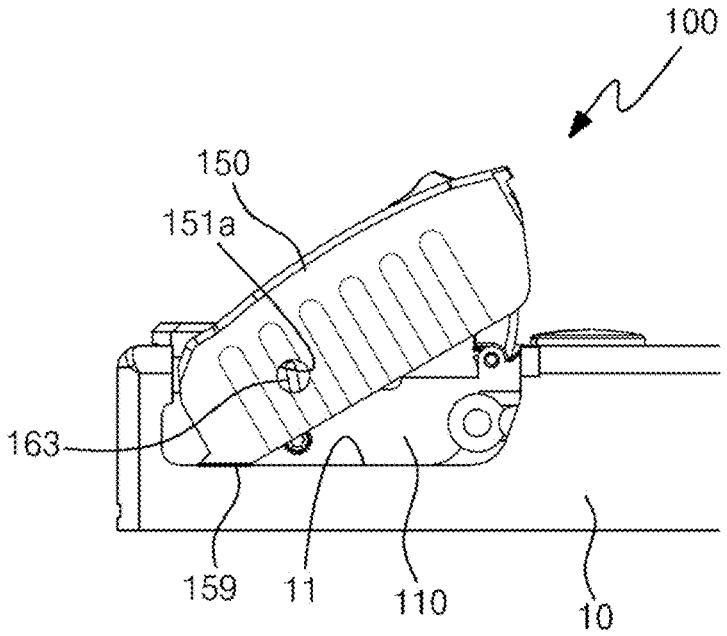
FIGS. 13(*a*)-13(*b*) and 14(*a*)-14(*b*) are diagrams showing a stopper according to an embodiment of the present invention.
Figure 13:
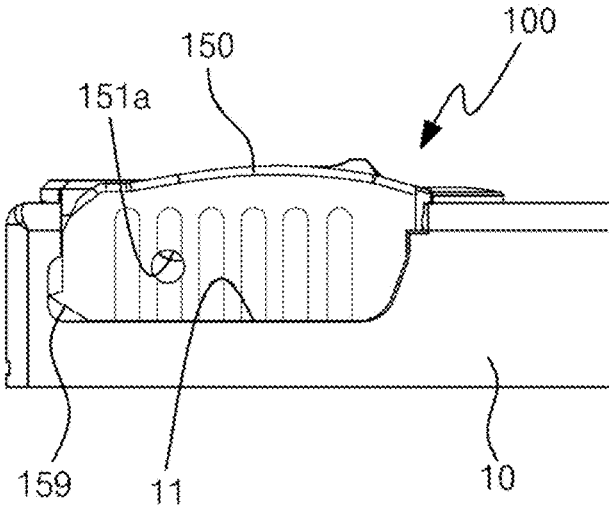

FIGS. 2 and 3 are diagrams showing a perspective view of a foldable dot sight device in a state in which a protective cover is opened. FIGS. 4 and 5 are diagrams showing a perspective view of a foldable dot sight device in a state in which a protective cover is closed. FIGS. 6 and 7 are diagrams showing a foldable dot sight device that is separated from the firearm. FIG. 8 is a diagram showing a bottom perspective view of a foldable dot sight device. FIGS. 9 and 10 are diagrams showing exploded perspective views of a foldable dot sight device. FIGS. 11 and 12 are diagrams showing exploded perspective views of a zeroing unit of a foldable dot sight device. FIGS. 13(*a*)-13(*b*) and 14(*a*)-14(*b*) are diagrams showing an embodiment of a stopper.

The foldable dot sight device of the present invention shown in the drawings is detachably assembled on the upper side of the rear end of a firearm and includes an aiming unit which is comprised of a body 110, a dot generator 120, a reflective mirror 130, a housing 140, a protective cover 150, and a zeroing unit 160.

In this embodiment, for convenience of explanation, the axis parallel to the longitudinal direction of the firearm 10 is described as a front-rear direction (Y), the axis perpendicular to the front-back direction in the horizontal direction is described as a left-right direction (X), and the axis perpendicular to the front-back and left-right directions in the vertical direction is described as an up-down direction (Z).

In this embodiment, a seating groove 11 in which the dot sight 100 can be seated is formed on the upper surface of the firearm 10. On one side of the seating groove 11, there is provided a body fastener 20 that is capable of fastening the body 110 in an assembled state, and on the other side of the seating groove 11, there is provided a cover locking unit 30 that is capable of locking the protective cover 150 when the protective cover 150 is in the folded position.

The seating groove 11 includes an upper surface groove 11*a* recessed from the upper surface of the firearm 10 and a side surface groove 11*b* recessed from each side of the firearm 10, respectively. At one end adjacent to the rear end of the firearm 10 of the side surface groove 11*b* on each side of the firearm 10, there is provided a first recess groove 12 which is recessed in the Y-axis direction. At the other end of one side of the side surface groove 11*b*, there is provided a first assembly groove 13 to which the body fastener 20 can be assembled, and on the other side of the side surface groove 11*b*, there is provided a second assembly groove 14 in which the cover locking unit 30 can be assembled.

The body fastener 20 is for fastening the body 110 of the dot sight 100 in a position. Accordingly, the body 110 can be restricted from being arbitrarily separated from the seating groove 11 by having one end of the first recess groove 12 affixing the position of the other end of the body 110. The body fastener 20 includes a fastening block 21 which is assembled in the X-axis direction with respect to a first assembly groove 13 provided in the side surface groove 11*b* of the firearm 10 by an insertion groove 22 recessed on one side of the rear end of the body fastener 20, a fastening ball 23 retractably disposed at a position corresponding to the insertion groove 22 on an inner wall surface facing the side surface groove 11*b* of the firearm 10, and a first spring 24 for elastically supporting the fastening ball 23 in the protruding direction.

The cover locking unit 30 is for affixing the position of the protective cover 150 in a folded state. Accordingly, the cover locking unit 30 includes locking block 32 having a locking protrusion 31 and capable of moving in the X-axis direction within the second assembly groove 14 and a second spring capable of elastically supporting the locking block 32. On the other hand, the locking protrusion 31 may have an upper side with an inclined surface so that it can be easily inserted into the locking groove 156 provided in the protective cover 150 while the protective cover 150 is closed.

The lower end portion of the body 110 provided such that the upper surface groove 11*a* and each side surface groove 11*b* can be seated and supported. A protrusion 110*a* capable of inserted in the first recess groove 12 is disposed in the rear end of the body 110. The second recess groove 110*b* into which a portion of the fastening block 21 can be inserted is formed to be recessed in the Y-axis direction at the tip of one side portion corresponding to the body fastener 20.

At the front end of the body 110, a first shaft insertion hole 111 in which a connecting shaft 144 rotatably connecting the housing 140 can be assembled is provided, and at each side of the rear end of the body 110, a pivot groove 113 into which a pivot shaft 153 provided on the protective cover 150 can be axially rotatably inserted and supported is provided.

At the rear end of the body 110, there is provided a connection passage 113*a* that connects the outer surface of the body 110 and the pivot groove 11 so that the pivot shaft 153 of the protective cover 150 can be inserted into the pivot groove 113. On each side of the pivot groove 113, there is provided a circular receiving groove 113*b* coaxial with the pivot groove 113 and capable of rotatably accommodating the support wing 154 of the protective cover 150.

At a position near the first shaft insertion hole 111 of the body 110, there is provided a support 112 capable of guiding the position of the fully unfolded state of the housing 140, and a permanent magnet M1 capable of magnetically fastening the housing 140 by magnetic force is provided on the support 112.

On the lower surface of the rear end of the body 110, there is provided a receiving space 114 in which the zeroing unit 160 and the dot generator 120 can be accommodated. On the upper surface of the body 110, there is provided an opening 114*c* that is connected to the receiving space 114 such that the dot beam generated by the dot generator 120 can be directed toward the reflective mirror 130, and inside the opening 114*c*, there is provided a protective window 115 for preventing foreign matter from being introduced into the receiving space 114.

At each side of the rear end of the body 110, there is provided a first shaft hole 114*a* that communicates with the receiving space 114 in the X-axis direction, and on the upper surface of the rear end of the body 110, there is provided a second shaft hole 114*b* that communicates with the receiving space 114 in the Z-axis direction.

On the other hand, an illuminance sensor 116 for controlling the brightness of the dot generator 120 may be provided on the upper surface of the body 110. A power supply 117 for applying power to the illuminance sensor 116 and the dot generator 120 may be provided inside the body 110. In the lower surface of the body 110, a wiring groove 118, in which wiring connecting the power supply 117 and the dot generator 120 can be accommodated, may be formed by indentation.

The dot generator 120 provides a dot for aiming a target and is disposed to face the reflective mirror 130 on the body 110. The dot generator 120 includes a light-emitting device (such as LED, not shown) and a mask (not shown) which may be used for determining the shape of the dot.

The reflective mirror 130 transmits the light beam from the target in front toward the user and at the same time reflects the dot provided from the dot generator 120 toward the user. The reflective mirror 130 is capable of passing through the light beam from the target in front to the user and reflect the light beam (i.e., the dot) irradiated from the dot generator 120 toward the user. Accordingly, the user can aim by superimposing the dot to the target in front.

Since the configuration of the dot generator 120 and the reflective mirror 130 is a general configuration applied to a dot sight device, a detailed description thereof will be omitted.

The housing 140 is rotatably connected to the body 110 so that it can be folded or unfolded with respect to the body 110 while keeping the reflective mirror 130 stationary. As such, the housing 140 may have a rectangular frame shape that can affix the edges of the reflective mirror 130. At the lower end of the housing 140, there may be provided a second shaft insertion hole 141 that may be disposed on the same axis as the first shaft insertion hole 111. On each side of the upper end of the housing 140, first guide protrusions 142*a* may be formed, and second guide protrusions 142*b* may be formed at positions spaced apart from the first guide protrusions 142*a* in the folding direction of the housing 140 by a predetermined distance.

On the other hand, a support surface 143 that can be supported by the support 112 of the body 110 in a state in which the housing 140 is fully unfolded may be provided at the lower front end of the housing 140 facing the target, and a magnetic body M2 capable of being adhered to the permanent magnet M1 of the support 112 may be provided on the support surface 143.

The housing 140 is rotatably connected to the body portion 110 by a connecting shaft 144 inserted into the first shaft insertion hole 111 and the second shaft insertion hole 141 while the first shaft insertion hole 111 and the second shaft insertion hole 141 are disposed on the same axis. One end of the housing 140 is supported by the body 110 and the other end is elastically supported in the unfolding direction by the first elastic member 145.

Accordingly, the housing 140 is elastically supported in the unfolding direction by the elastic force of the first elastic member 145 so that the support surface 143 of the housing 140 is in close contact with the support 112 of the body 110, and since the magnetic body M2 provided on the support surface 143 of the housing 140 is attached to the permanent magnet M1 provided on the support 112, the unfolded state is stably maintained. As a result, it is possible to prevent the reflective mirror 130 from being moved arbitrarily due to external shock or vibration.

The protective cover 150 may be used for moving the housing 140 in a folding or unfolding direction according to a rotational position. The protective cover 150 may include sidewalls 151 surrounding each side of the body 110, a connection bridge 152 connecting the upper end of the sidewall 151, a pivot shaft 153 formed on the inner surface of the sidewall 151 facing the side surface of the body 110 and axially rotatably inserted into the pivot groove 113 of the body 110, and a sliding guide 155 formed on the inner surface of the sidewall 151 to guide the movement of the first guide protrusion 142*a* and the second guide protrusion 142*b*.

In the front end of one sidewall 151, there is provided a locking groove 156 into which the locking protrusion 31 can be selectively engaged according to the operating state of the cover locking unit 30.

In addition, the protective cover 150 includes stoppers 159 and 159' capable of guiding the unfolding position by restricting additional rotation when the protective cover 150 is already rotated in the unfolding direction.

For example, as shown in FIGS. 13(*a*) and 13(*b*), the stopper 159 may be formed in the form of a contact surface provided below the rear end of the sidewall 151 of the protective cover 150, and this contact surface may contact the upper surface of the firearm 10 when the protective cover 150 is moved to the unfolding position so that the unfolding position of the protective cover 150 may be guided by limiting the additional rotation of the protective cover 150.

Figure 32A:
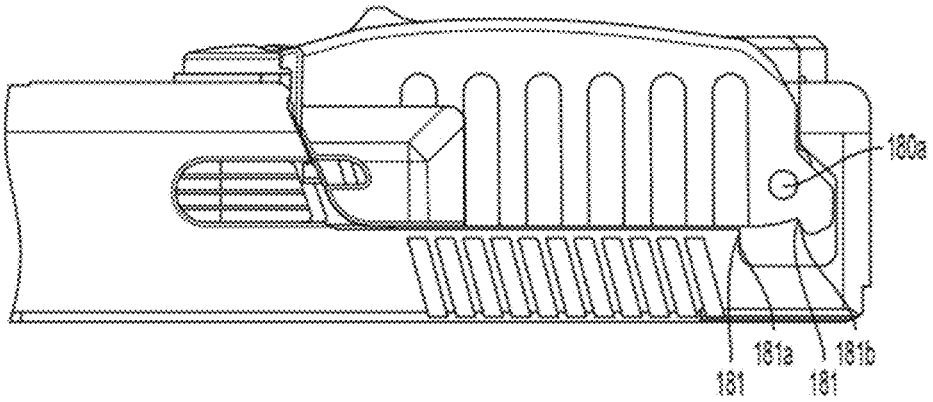
Figure 32B:
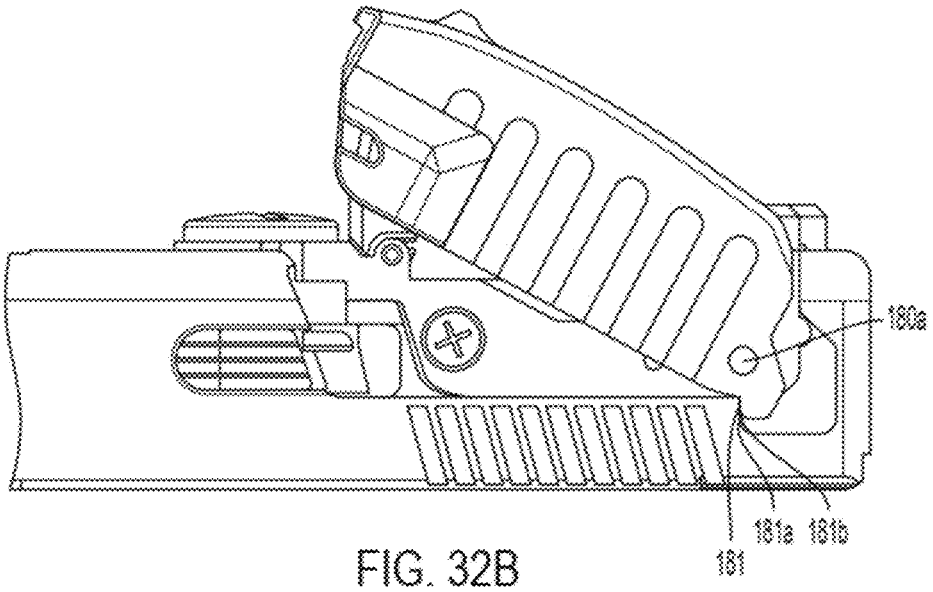
Figure 32C:
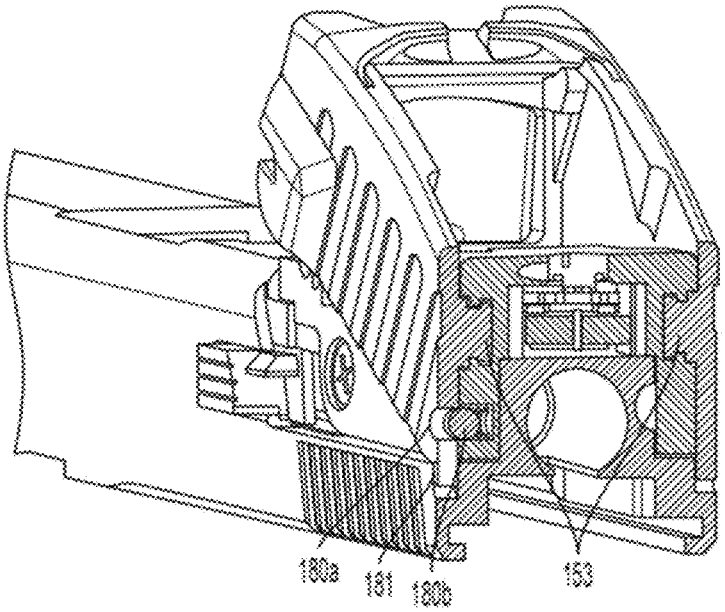

FIGS. 32(*a*)-32(*c*) shows another embodiment of the present invention wherein stoppers 180 and 181 have a different form but serve similar function as the stoppers 159 depicted in FIGS. 13(*a*) and 13(*b*). In such an embodiment, when the protective cover 150 is moved to the unfolding position, the stopper 181 that limits the additional rotation of the protective cover 150 comes in contact vertically with a second contact element 181*b* such that the unfolding position is fixed, and the second contact element 180*b* is disposed on the protective cover 150 and the first contact element 181*a* is disposed on the side of the body 110. In another embodiment of the present invention, a fixing hole 180*a* is disposed in a lower part of the pivot axis 153 of the protective cover and a fixing ball and elastic element 180*b* is disposed on the side of the body. When the protective cover is in the unfolding position, the fixing ball 180*b* is inserted into fixing hole 180*a* by the elasticity of the elastic element such that the unfolding position of the protective cover 150 is fixed.

While 4 different types of stoppers (159, 159', 181, 180) are described in the above-described embodiments, one or more of the embodiments of the stoppers may be combined to reinforce or increase the fixing strength of the unfolding position of the protective cover 150.

Figure 14:
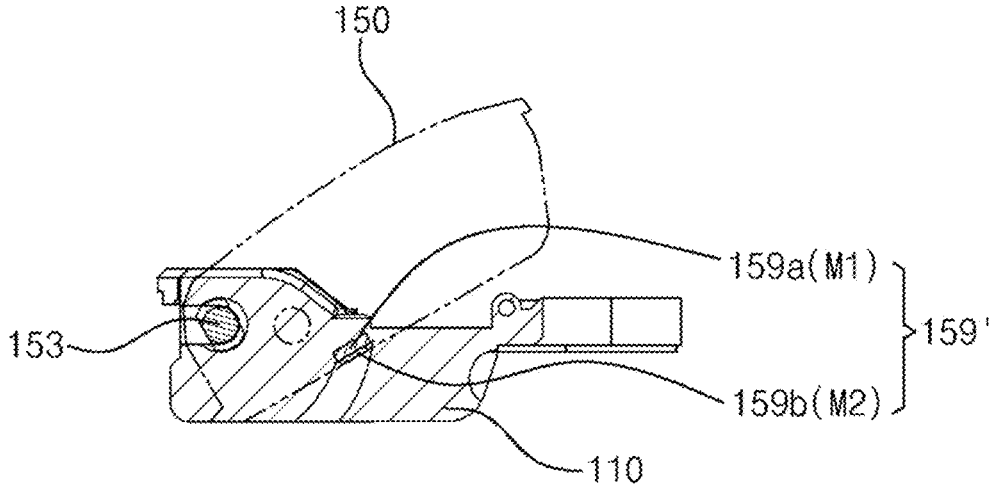
Figure 14:
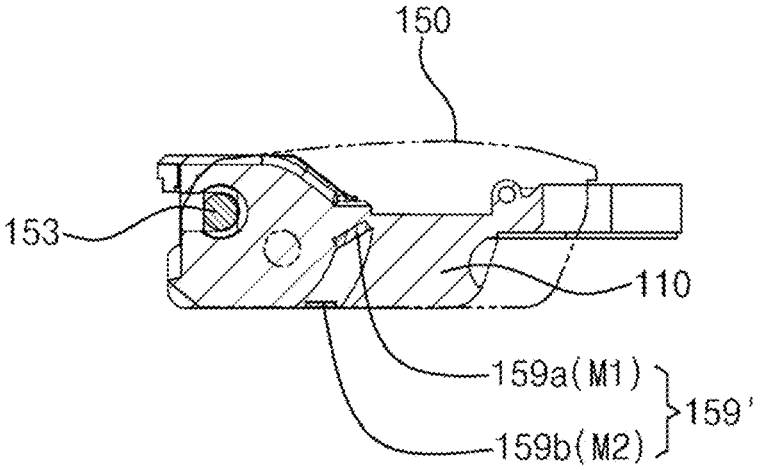

In addition, as shown in FIGS. 14(*a*) and 14(*b*), the stopper 159' may be divided into two components—one disposed in the body 110 to form a first contact 159*a* and the other disposed in the protective cover 150 to form a second contact 159*b*. In this configuration, the second contact 159*b* comes in contact with the first contact 159*a* when the protective cover 150 is in the unfolded state, thereby limiting additional rotation of the protective cover 150 and guide the unfolding position of the protective cover 150. In addition, a permanent magnet M1 and a magnetic material M2 that can be attached by magnetic force may be provided in the first contact 159*a* and the second contact 159*b*, respectively. For example, a permanent magnet M1 may be disposed on the first contact 159*a*, and a magnetic material M2 capable of being attached to the permanent magnet M1 may be disposed on the second contact 159*b*, and accordingly, in a state in which the protective cover 150 is moved to the unfolded position, the first contact 159*a* and the second contact 159*b* are fixed by magnetic force, thereby arbitrary rotation of the protective cover 150 in the folding direction can be prevented.

When the protective cover 150 is rotated to the unfolded position, the protective cover 150 is set to be separated from the housing 140 that is moved to the unfolded position. More specifically, when the protective cover 150 is moved to the unfolded position, the first guide protrusion 142*a* of the housing 140 is disposed at a position deviated from the movement trajectory of the sliding guide 155, and the second guide protrusion 142*b* is separated from the sliding guide 155 within the movement trajectory of the sliding guide 155. That is, since the protective cover 150 is in a state separated from the housing 140 in the unfolded position, arbitrary movement of the reflective mirror 130 supported on the housing 140 caused by the external force acting on the protective cover 150 can be prevented.

When one end of the protective cover 150 is rotatably supported by the body 110, the protective cover 150 is elastically supported in an unfolding direction from the body 110 by the second elastic member 158.

The sliding guide 155 is formed in a shape that can determine the rotational position of the housing 140 according to the rotational position of the protective cover 150, and the connecting bridge 152 is formed in a form that can firmly connect each sidewall 151 within a range that does not block the view between the user and the target when the protective cover 150 is fully unfolded.

The pivot shaft 153 includes a pair of support wings 154 extending in the radial direction. The width of the support wing 154 is set smaller than the width of the connection passage 113*a*, and the extension direction of the support wings 154 is set so as not to coincide with the connection passage 113*a* when the protective cover 150 rotates to fold or unfold the housing 140. The outer edge of the pair of support wings 154 is set to form a circular arc corresponding to the inner circumferential surface of the circular receiving groove 113*b*, and the pair of support wings 154 and the circular receiving groove 113*b* which are provided in a plurality are spaced apart along the axial direction of the pivot shaft 153.

In addition, on the upper surface of the connecting bridge 152 of the protective cover 150, a rear sight (RS) capable of aiming at a target in the front in connection with a front sight (not shown) provided at the front end of the firearm 10 is formed, whereby the rear sight (RS) may be disposed in the aiming position while the protective cover 150 is rotated to the folded position.

The zeroing unit 160 supports the dot generator 120 in the receiving space 114 located in the inner region of the protective cover 150 on the body 110. The zeroing unit 160 is configured so that the position of the dot generator 120 can be finely adjusted left, right, up, and down.

More specifically, the zeroing unit 160 includes a support body 161 for supporting the dot generator 120, a left/right moving block 162 that is vertically and slidably assembled to the support body 161, a left/right adjustment 163 that is axially rotatably supported by the first shaft hole 114*a* and that is screwed-coupled to the left/right movement block 162 for adjusting the left and right position of the left/right movement block 162 according to the shaft rotation direction, an up/down movement block 164 that is laterally and slidably assembled to the support body 161, an up/down adjustment 165 that is axially rotatably supported by the second shaft hole 114*b* of the body 110 and that is screw-coupled to the up/down movement block 164 for adjusting the up and down position of the up/down movement block 164, and a spring 166 that is interposed between the body 110 and the up/down movement block 164 to elastically support the up/down movement block 164 in a downward direction.

The left/right adjustment 163 and the up/down adjustment 165 can each be axially rotatably supported in the first shaft hole 114*a* and the second shaft hole 114*b* of the body 110 by a fastening clip 167, respectably. A groove may be provided in the head portion located at the rear end of the zeroing unit 160 so that it can be axially rotated using a separate tool.

In addition, the sidewall 151 of the protective cover 150 is provided with a through-hole 151*a* through which the left/right adjustment 163 can be exposed when the protective cover 150 is fully unfolded.

That is, as shown in FIG. 13(*a*), the through-hole 151*a* is disposed at a position corresponding to the left/right adjustment 163 when the protective cover 150 is fully unfolded, and as shown in FIG. 13(*b*), the through-hole 151*a* is disposed at a position deviated from the left/right adjustment 163 when the protective cover 150 is folded. Accordingly, the left/right adjustment 163 can be operated only in the unfolded state of the protective cover 150.

The zeroing unit 160 further includes a pressure support unit 170 that can prevent the left/right control unit 163 and the up/down control unit 165 from rotating arbitrarily. The pressure support unit 170 includes a pressure head 171 disposed on the side of the head of the left/right adjustment 163 and the up/down adjustment unit 165, an elastic member 172 elastically supporting the pressure head 171 toward the head portion, and an adjustment screw 173 that is screwed-coupled to the body 110 while supporting the rear end of the elastic member 172 and that can adjust the elastic force of the elastic member 172 by adjusting the distance between the pressure head 171 and the elastic member 172 by the axial rotation of the adjustment screw 173. In addition, it is preferable that minute grooves are formed at regular intervals on the outer peripheral surface of the head portion so that the axial rotation of the left/right adjustment 163 and the up/down adjustment 165 is prevented by the pressure applied by the pressure head 171.

The dot sight device illustrated in this embodiment through drawings and examples is intended to highlight the ease of portability and storage enabled by foldable the housing 140 and the protective cover 150. While a pistol is used in drawings in this disclosure, it is possible that the foldable dot sight device disclosed herein can be used in a variety of firearms including rifles.

Now, the operation of the first embodiment of the foldable dot sight device described above will be described.

Figure 15:
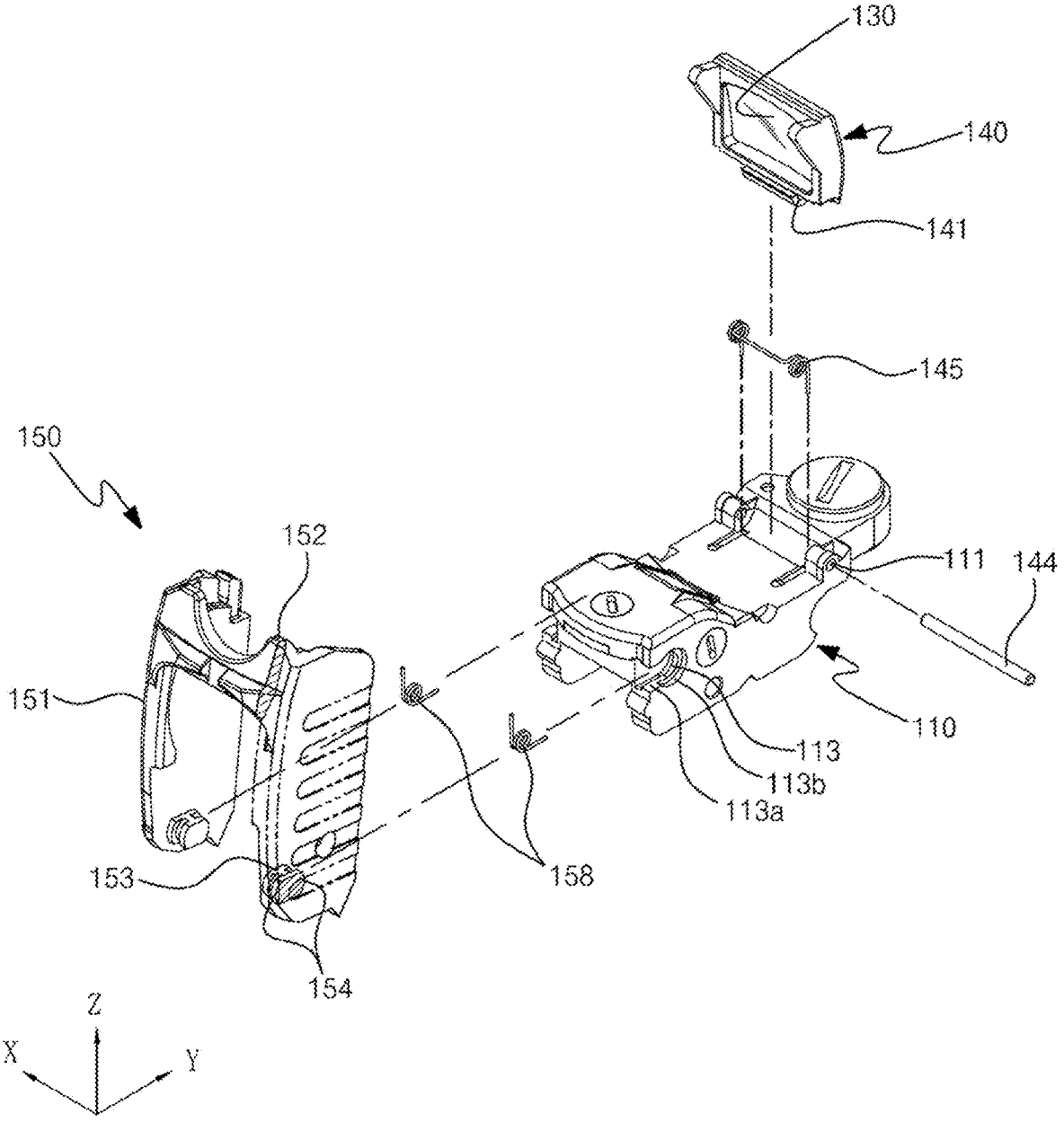
FIGS. 15 to 18 are diagrams showing an assembly structure of a protective cover, a body, and a housing according to an embodiment of the present invention.
Figure 16:
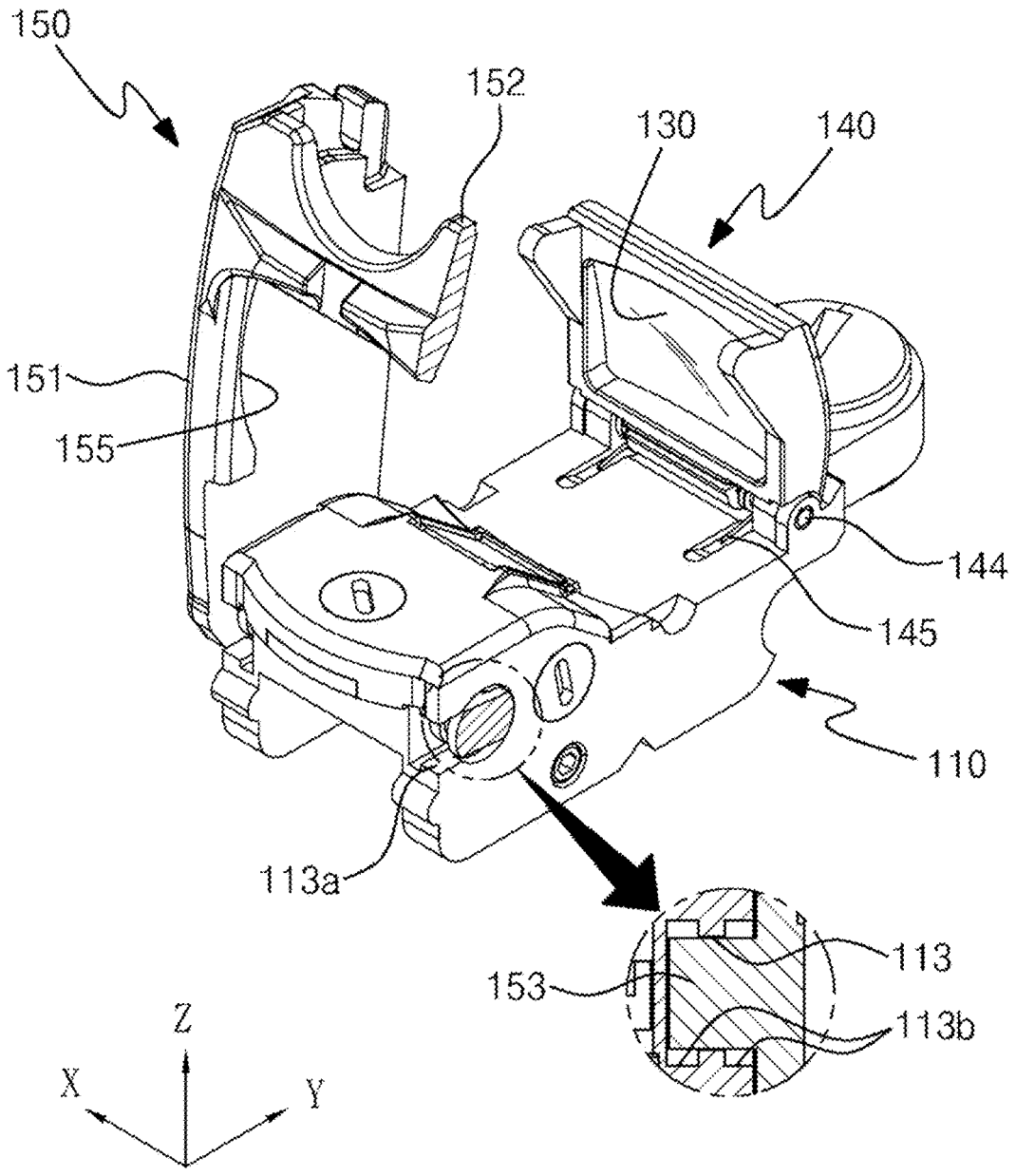
Figure 17:
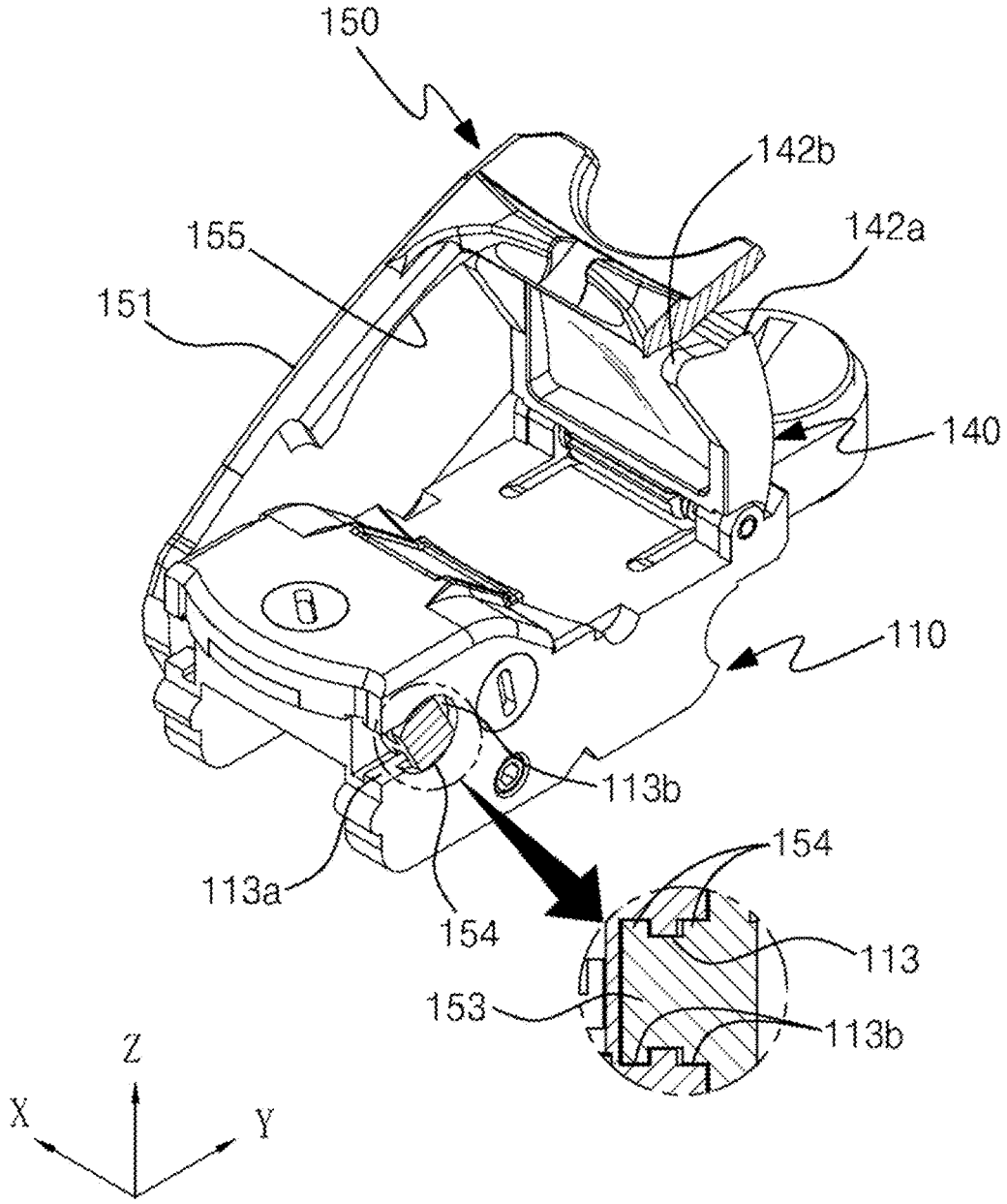
Figure 18:
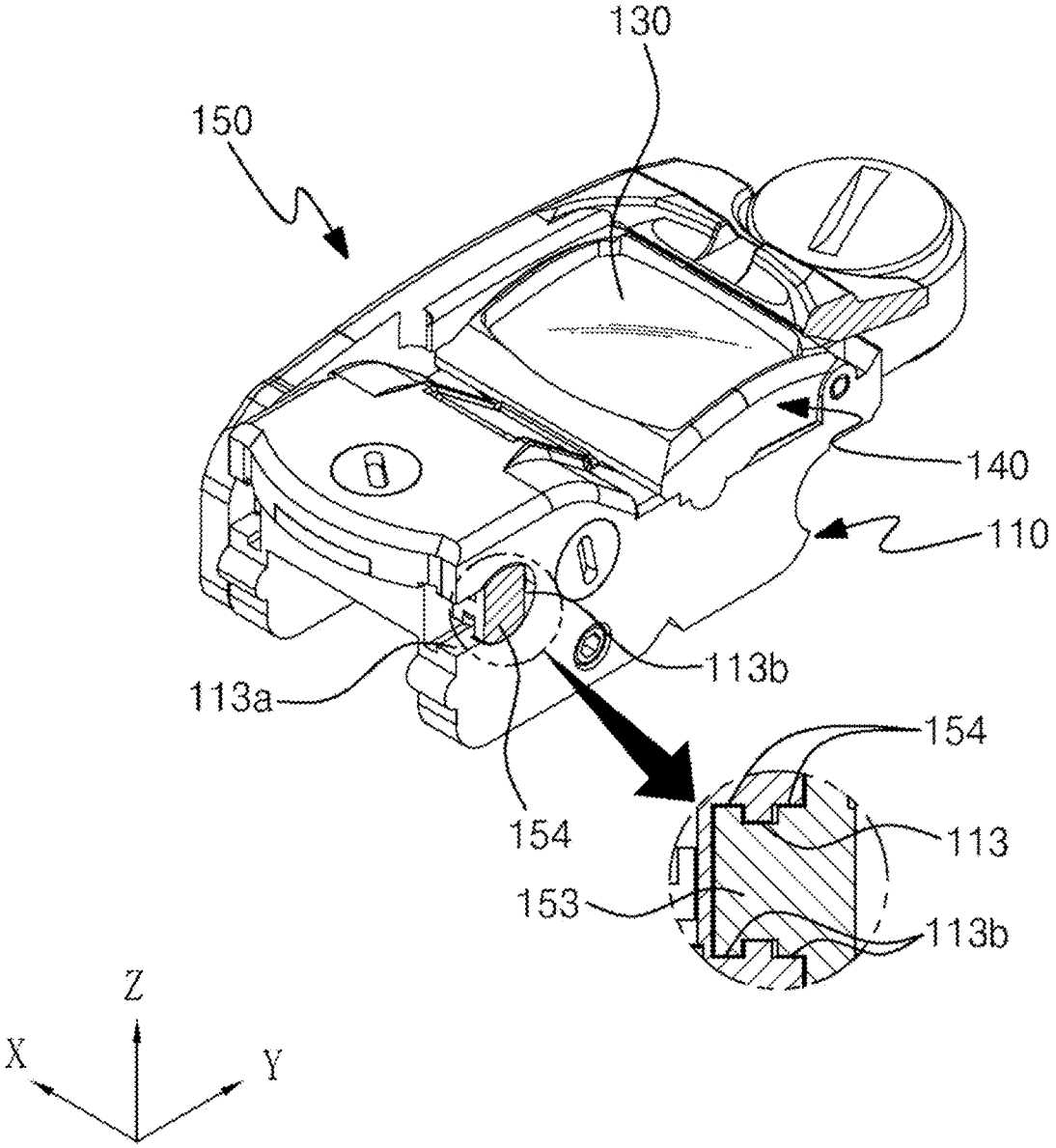

FIGS. 15 to 18 of the accompanying drawings show the assembly structure of the protective cover, the body, and the housing according to the foldable dot sight device of the present invention. FIG. 15 is a diagram showing an exploded view where the body 110, the protective cover 150, and the housing 140 are separated. FIG. 16 is a diagram showing a state in which the protective cover 150 and the housing 140 are assembled to the body 110. FIG. 17 is a diagram showing a state in which the protective cover 150 and the housing 140 are connected and unfolded. FIG. 18 is a diagram showing a state in which the protective cover 150 and the housing 140 are folded.

First, as shown in FIGS. 15 and 16, the housing 140 is rotatably assembled to the body 110 by the second insertion hole 141 provided at the lower end of the housing 140 and the connecting shaft 144 which is inserted into the first insertion hole 111 of the body 110 and is elastically supported in the unfolding direction by the first elastic member 145.

In the protective cover 150, the pivot shaft 153 is provided inside one end of the sidewalls 151, and the pivot shaft 153 is inserted into the pivot groove 113 via the connection passage 113*a* of the body 110. At this time, since the width of the support wing 154 extending in the radial direction from the outer circumferential surface of the pivot shaft 153 is set smaller than the width of the connection passage 113*a*, the support wing 154 of the pivot shaft 153 may be smoothly inserted into the circular receiving groove 113*b* through the connection passage 113*a*.

On the other hand, since the outer peripheral surface of the support wing 154 is made of a circular arc corresponding to the inner peripheral surface of the circular receiving groove 113*b*, the support wing 154 can rotate within the circular receiving groove 113*b* when the protective cover 150 rotates.

Next, to couple the guide protrusions 142 formed on each side of the housing 140 to the sliding guide 155 formed on the inner surface of the sidewall 151 of the protective cover 150, the protective cover 150 must be rotated at a certain angle. Since the support wing 154 does not coincide with the connecting passage when the protective cover 150 is rotated to the unfolded position as shown in FIG. 17, it is possible to prevent the pivot shaft 153 from being arbitrarily separated from within the pivot groove 113.

In addition, as shown in FIG. 18, even when the protective cover 150 and the housing 140 are folded, the support wings 154 rotate together with the protective cover 150 so that they do not coincide with the connection passage 113*a*. Accordingly, it is possible to prevent the pivot shaft 153 from being arbitrarily separated from within the pivot groove 113.

That is, since the extending direction of the support wing 154 does not coincide with the connection passage 113*a* in the process of rotating the protective cover 150 to fold or unfold the housing 140, it is possible to easily assemble the protective cover 150 to the body 110 while preventing the pivot shaft 153 from the pivot groove 113 when the protective cover 150 is being folded and unfolded.

In particular, since a plurality of support wings 154 as described above are provided and separated from each other in the axial direction on the pivot shaft 153 to be accommodated in the circular receiving grooves 113*b* provided on both sides of the pivot groove 113, respectively, it is possible to restrict the movement of the pivot shaft 153 in the axial direction within the pivot groove 113.

As such, the protective cover 150 is rotatably assembled to the body 110 by the pivot shaft 153 which is inserted into the pivot groove 113 of the body 110, and the second elastic member 158 is elastically supported in the unfolding direction.

Figure 19:
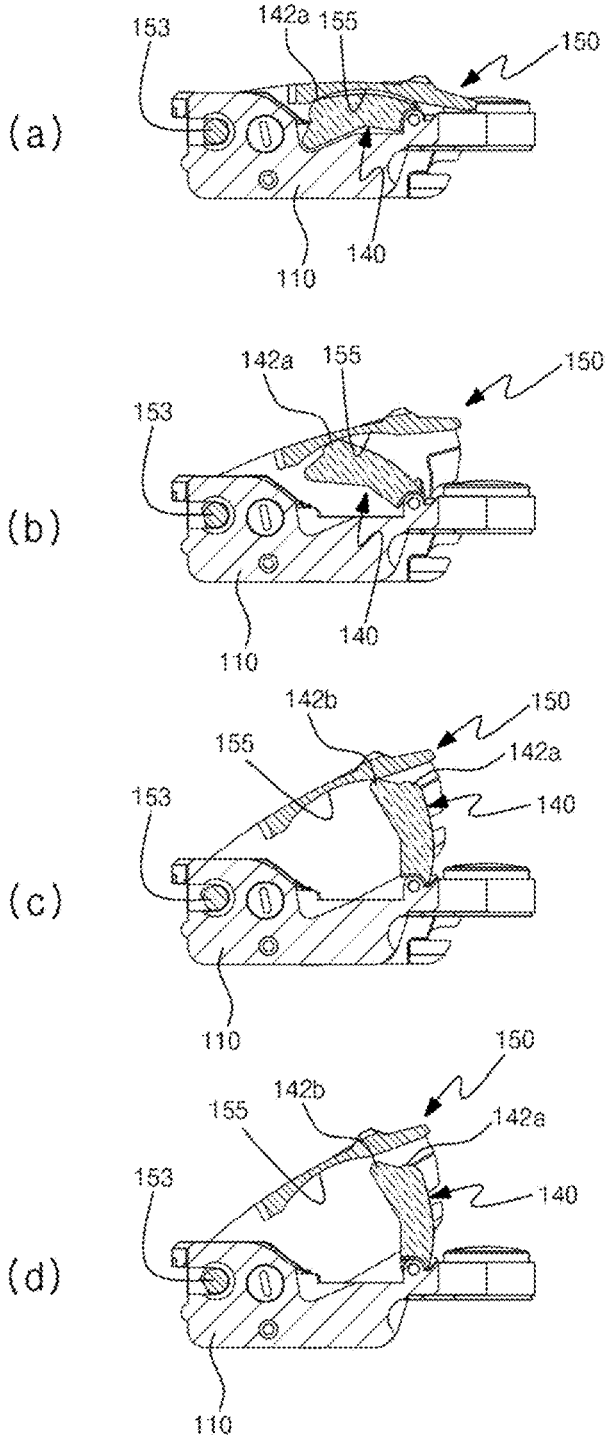
FIGS. 19(*a*)-19(*d*) are diagrams showing interlocking actions of a protective cover and a housing according to an embodiment of the present invention.

FIG. 19(*a*)-19(*d*) are diagrams showing the interlocking action of the protective cover and the housing according to the foldable dot sight device of the present invention.

The protective cover 150 is rotatably connected to the pivot shaft 153 on the body 110. The housing 140 is connected rotatably about the connecting shaft 144 on the body 110. The protective cover 150 and the housing 140 are elastically supported in the unfolding direction by the first elastic member 145 and the second elastic member 158, respectively.

At this time, the sliding guide 155 of the protective cover 150 is disposed in the upper direction of the first guide protrusion 142*a* of the housing 140. Since the first guide protrusion 142 is elastically in close contact with the sliding guide 155 by the elastic force of the first elastic member 145, the housing 140 can be rotated to the folded or unfolded position according to the rotational position of the protective cover 150.

That is, when the protective cover 150 is fully folded as shown in FIG. 19(*a*), the housing 140 interlocking with the protective cover 150 maintains a folded state since the first sliding protrusion 142*a* of the housing 140 is pressed against the sliding guide 155 of the protective cover 150. At this time, since the housing 140 is elastically supported in the unfolding direction by the first elastic member 145, the first sliding protrusion 142*a* is in a state in which it elastically adheres to the sliding guide 155.

In this state, when the protective cover 150 rotates in the unfolding direction about the pivot shaft 153 as shown in FIG. 19(*b*), the first guide protrusion 142*a* in close contact with the sliding guide 155 by the elastic pressing force of the first elastic member 145 slides along the sliding guide 155, and accordingly, the housing 140 is rotated in the unfolding direction about the connecting shaft 144 in conjunction with the rotation of the protective cover 150 to be in a fully unfolded state as shown in (c) of FIG. 19.

Then, as shown in FIG. 19(*d*), the protective cover 150 is further rotated to a fully unfolded state from the fully unfolded state of the housing 140, and in this state, the sliding guide 155 of the protective cover 150 is separated from the first guide protrusion 142*a* and the second guide protrusion 142*b* of the housing 140.

In this way, the protective cover 150 is separated from the housing 140 in the fully unfolded state, and it is possible to prevent the reflective mirror 130 supported on the housing 140 from being shaken by an external force acting on the protective cover 150.

Figure 20:
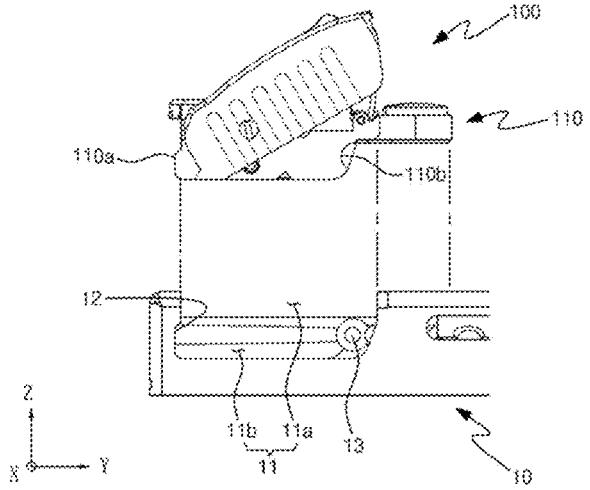
FIGS. 20 to 23 are diagrams showing an assembly process of a body and a firearm using the body fastener according to an embodiment of the present invention.
Figure 21:
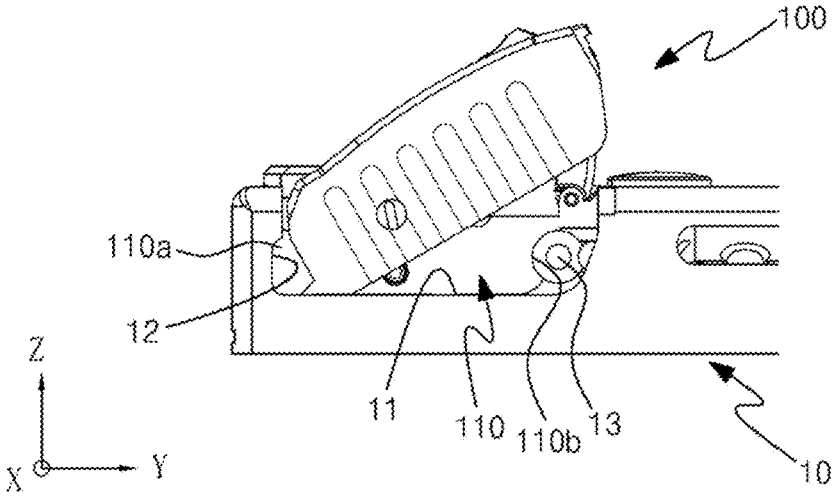
Figure 22:
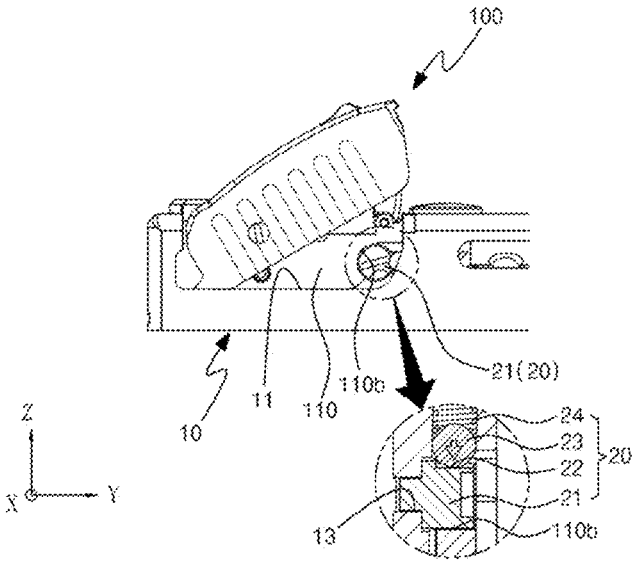
Figure 23:
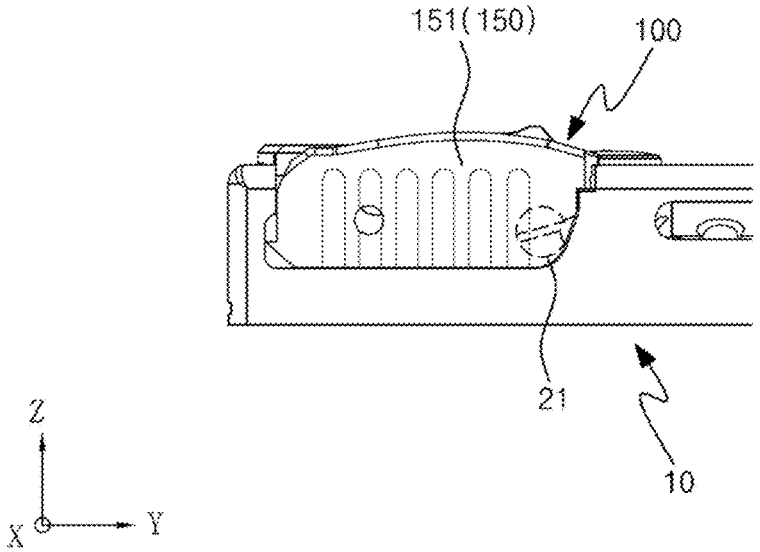

FIGS. 20 to 23 are diagrams showing the assembly process of the body and the firearm using the body fastener according to the dot sight device of the present invention. FIG. 20 is a side view showing a state in which the firearm 10 and the dot sight 100 are separated. FIG. 21 is a side view showing a state in which the body 110 of the dot sight 100 is seated in the seating groove 11 of the firearm 10. FIG. 22 is a side view showing a state in which the body 110 is fixed to the seating groove 11 using the body fastener 20. FIG. 23 is a side view showing a folded state of the protective cover 150 of the dot sight 100.

First, as shown in FIG. 20, the seating groove 11 of the firearm 10 includes an upper groove 11*a* recessed from the top surface of the firearm 10 and a side surface groove 11*b* recessed from the side surface of the firearm 10. The body 110 of the dot sight 100 is configured to be inserted into the upper surface groove 11*a* and the side surface groove 11*b* of the seating groove 11, respectively, and the second recess groove 110*b* provided on the side surface of the body 110 is disposed at a position where it is exposed when the protective cover 150 is unfolded.

Then, when the body 110 of the dot sight 100 is inserted into the seating groove 11 as shown in FIG. 21, movement of the body 110 in the left and right directions (X-axis) and front-rear direction (Y-axis) on the firearm 10 is restricted as the lower end of the body 110 is seated and supported in the seating groove 11.

On the other hand, the protrusion 110*a* provided at the rear end of the body 110 is inserted into the first recess groove 12 of the firearm 10, and the second recess groove 110*b* provided at the tip of the body 110 coincides with the first assembly groove 13 of the firearm 10.

In this state, when the fastening block 21 of the body fastener 20 is inserted into the first assembly groove 13 of the firearm 10 as shown in FIG. 22, a part of the fastening block 21 is inserted into the second recess groove 110*b* of the front end of the body 110, thereby preventing the body 110 from moving in the upward direction. Accordingly, the position of the body 110 can be stably fixed.

When the fastening block 21 is inserted into the first assembly groove 13, the fastening ball 23 elastically supported in the protruding direction by the first spring 24 in the firearm 10 is insert-supported in the insertion groove 22 that is indented at one side of the rear end of the fastening block 21. Accordingly, it is possible to prevent the fastening block 21 from being arbitrarily separated from the first assembly groove (13), On the other hand, the dot sight 100 can easily be separated from the firearm 10. When the fastening block 21 is axially rotated, the fastening ball 23 is separated from the insertion groove 22 of the fastening block 21, and accordingly, the fastening block 21 can be separated from the first assembly groove 13. As a result, the body 110 can be easily separated from the seating groove 11.

In addition, as shown in FIG. 23, in the folded state of the protective cover 150 of the dot sight 100, the fastening block 21 is completely concealed by the sidewall 151 of the protective cover 150, and the separation of the fastening block 21 is prevented. Accordingly, it is possible to prevent the body 110 from being arbitrarily separated from the firearm 10 during carrying and storage.

Figure 24:
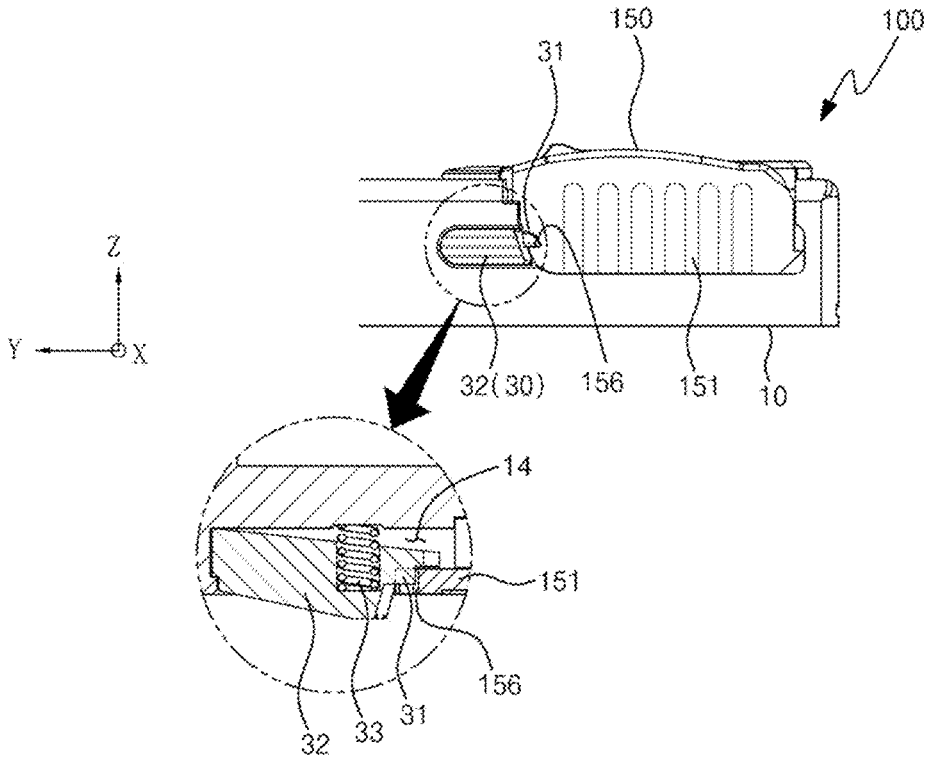
FIGS. 24 and 25 are diagrams showing a folded state of a protective cover using a cover locking unit according to an embodiment of the present invention.
Figure 25:
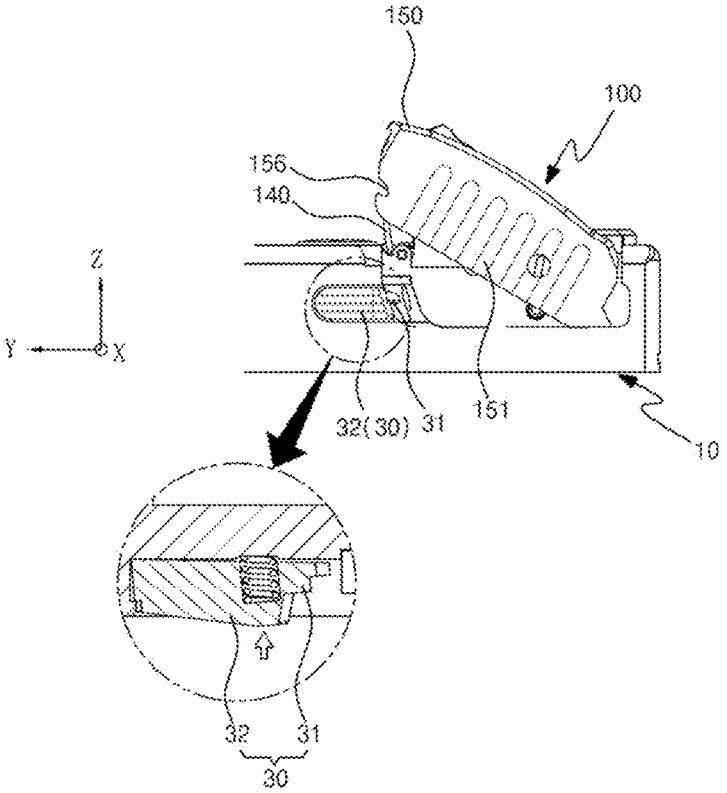

FIGS. 24 and 25 are diagrams showing the folded state of the protective cover using the cover locking unit according to the foldable dot sight device of the present invention. FIG. 24 is a side view showing a state in which the protective cover 150 is fully folded, and FIG. 25 is a side view showing a state in which the protective cover 150 is fully unfolded.

As shown in FIG. 24, when the protective cover 150 is folded, the locking groove 156 formed in the sidewall 151 of the protective cover 150 is engaged with the locking protrusion 31 of the cover locking unit 30 provided on one side of the firearm 10. Accordingly, the arbitrary unfolding of the protective cover 150 can be limited.

As shown in the enlarged cross-sectional view of FIG. 24, in the cover locking unit 30, the locking protrusion 31 and the locking groove 156 are engaged with each other when the locking block 32 is received in the second assembly groove 14 as the locking block is elastically supported in the protruding direction by the second spring 33.

From this state, if the locking block 32 is pressed from the side of the firearm 10 as shown in FIG. 25, the locking protrusion 31 of the locking block 32 is separated from the locking groove 156 of the protective cover 150, and accordingly, the locking cover is released and can be rotated in the unfolding direction.

More specifically, since the housing 140 folded together with the protective cover 150 is elastically supported in the unfolding direction by the first elastic member 145 (see FIG. 9), when the cover locking unit 30 is released from the fixed state as described above, the protective cover 150 is rotated in the unfolding direction by the second elastic member 158, and in conjunction with this, the housing 140 is rotated in the unfolding direction by the first elastic member 145 (see FIG. 19).

That is, when the locking block 32 of the cover locking unit 30 is pressed to release the protective cover 150 and the housing 140 fixed in the folded state, the protective cover 150 and the housing 140 are unfolded, thereby allowing the user to aim quickly using the dot sight device, and, therefore, it is possible to quickly respond even in an emergency situation.

Figure 26:
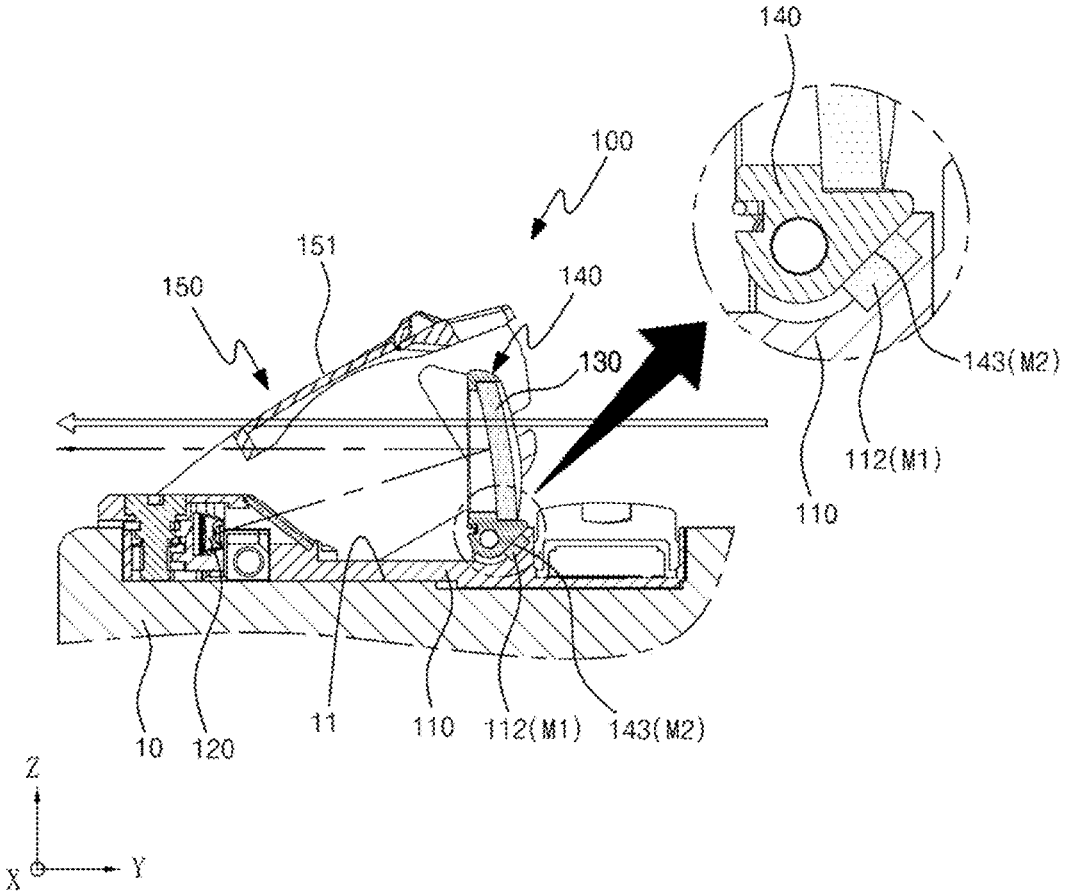
FIGS. 26 and 27 are diagrams showing cross-sectional views of folded and unfolded state of a protective cover and a housing according to an embodiment of the present invention.
Figure 27:
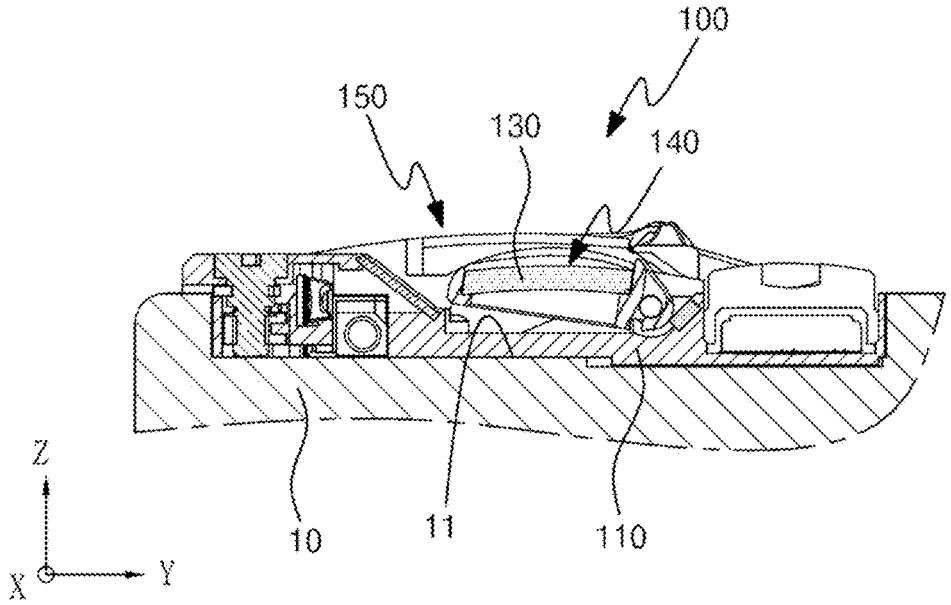

FIGS. 26 and 27 are diagrams showing cross-sectional views of folded and unfolded state of the protective cover and the housing. FIG. 26 is a side cross-sectional view showing a state in which the protective cover 150 and the housing 140 are unfolded, and FIG. 27 is a side cross-sectional view showing a state in which the protective cover 150 and the housing 140 are folded.

First, as shown in FIG. 26, the dot sight 100 of this embodiment can be detachably assembled in the body 110 of the mounting groove 11 of the firearm 10, and when the protective cover 150 of the dot sight 100 is unfolded, the housing 140 is unfolded in conjunction with the protective cover 150, and, at the same time, the reflective mirror 130 supported by the housing 150 is placed between the user and the target.

In this state, the reflective mirror 130 reflects the dot beam provided from the dot generator 120 toward the user and, at the same time, transmits the target on the front toward the user, thereby allowing the user to aim by superimposing the dot on the front target.

On the other hand, as shown in FIG. 27, when the protective cover 150 and the housing 140 of the dot sight 100 are folded, the size of the dot sight 100 can be reduced. Therefore, when the dot sight device of the present invention is applied to a pistol, it can be easily carried and stored. Furthermore, the dot sight device attached to a pistol will not interfere with the process of taking the pistol out of the holster.

Figure 28:
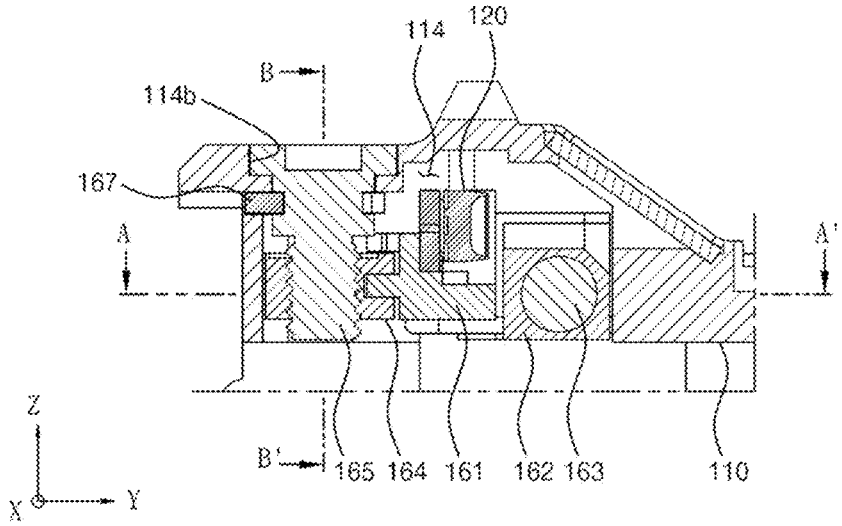
FIGS. 28-31 and 32(*a*)-32(*c*) are diagrams showing an assembly structure of a zeroing unit according to an embodiment of the present invention.
Figure 29:
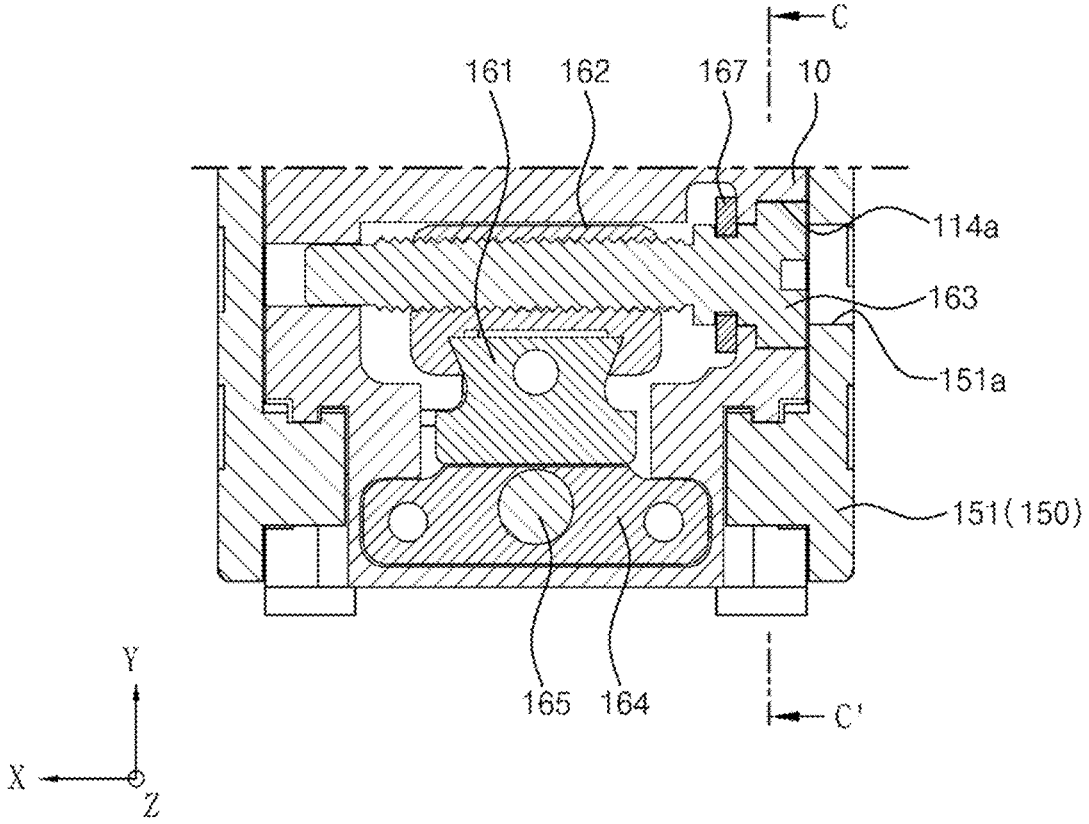
Figure 30:
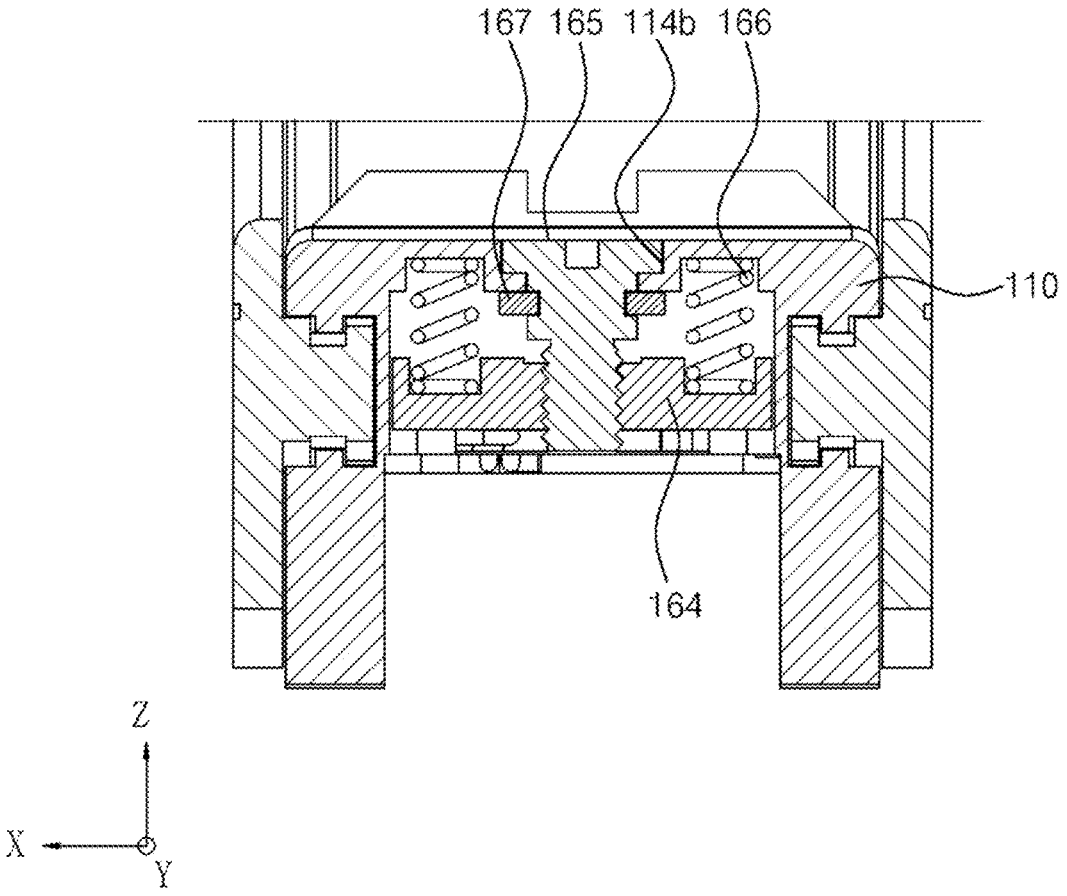
Figure 31:
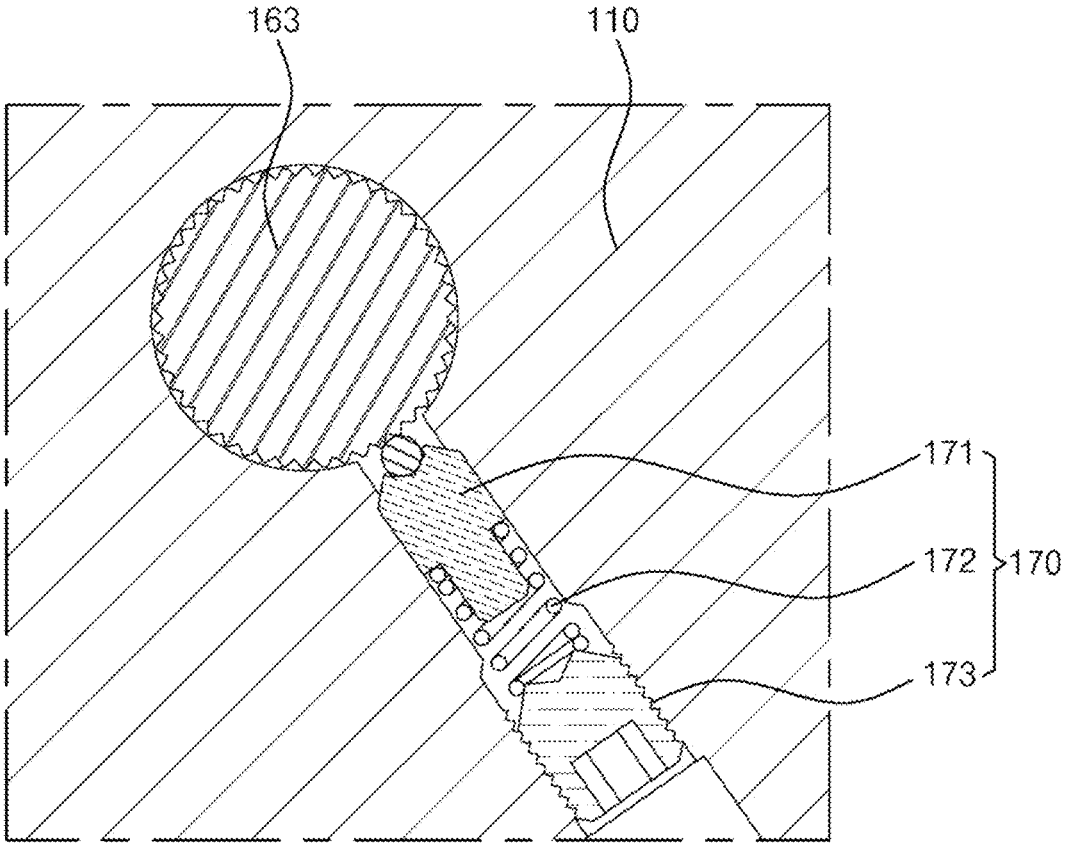

FIGS. 28 to 31 are diagrams showing an assembly structure of a zeroing unit of the dot sight device of the present invention. FIG. 28 is a side cross-sectional diagram showing the assembled state of the zeroing unit, FIG. 29 is a cross-sectional diagram taken along line A-A' of FIG. 28, FIG. 30 is a cross-sectional diagram taken along line B-B' of FIG. 28, and FIG. 31 is a cross-sectional diagram of line C-C' of FIG. 29.

First, as shown in FIGS. 28 to 30, the dot generator 120 can be moved up and down (Z), left and right (X) by the zeroing unit 160 within the receiving space 114 of the body 110.

More specifically, when the left/right adjustment 163 supported axially rotatably in the first shaft hole 114*a* of the body 110 is rotated, the left/right movement block 162 screwed-coupled to the left/right adjustment 163 moves left and right, enabling the support body 161 to which the dot generator 120 is fixed to move left and right.

In addition, when rotating the upper/lower adjustment 165 supported axially on the second shaft hole 114*b* of the body 110, the up/down movement block 164 screwed couple to the up/down adjustment 165 moves up and down, enabling the support body 161 to which the dot generator 120 is fixed to move up and down.

On the other hand, the left/right adjustment 163 and the up/down adjustment 165 may be supported in a rotatable state in the first shaft hole 114*a* and the second shaft hole 114*b* by the fastening clip 167, respectively.

As described above, since the position of the dot generator 120 can be adjusted using the left/right adjustment 163 and the up/down adjustment 165, the shooting accuracy can be improved.

On the other hand, the left/right movement block 162 is vertically and slidably connected to the support body 161 and the up/down movement block 164 is laterally and slidably connected to the support body 161. As such, when the support body 161 is moving left and right by the left/right movement block 162, the support body 161 slides left and right with respect to the up/down movement block 164, and when the support body 161 is moving up and down by the up/down movement block 162, the support body 161 slides up and down with respect to the left/right movement block 164.

In addition, since the up/down movement block 164 is elastically supported in the downward direction by the elastic spring 166 interposed between the body 110 and the up/down movement block 164, it is possible to prevent minute movement due to the screw-coupling tolerance of the up/down movement block 164 and the up/down adjustment 165, thereby further improving the shooting precision.

On the other hand, while it has been described in this embodiment that the spring 166 is applied only to the up/down movement block 164 as an example, the left/right movement block 162 may also be elastically supported in one direction parallel to the left/right adjustment 163 by the spring 166.

FIG. 31 shows the pressure support unit 170 for preventing the left/right adjustment 163 and the up/down adjustment 165 from arbitrarily rotating the shaft.

The pressure head 171 of the pressure support unit 170 is movably disposed in the body 110 in a direction crossing the axial direction of the left/right adjustment 163, the elastic member 172 elastically supports the pressure head 171 toward the head portion of the left/right adjustment 163, and the adjustment screw 173 is screwed-coupled to the body 110 while supporting the rear end of the elastic member 172 to adjust the axial position.

A number of fine grooves are formed on the outer peripheral surface of the head portion of the left/right adjustment 163, and while the front end of the pressure head 171 is engaged with the groove, the pressure head 171 and the groove is elastically in close contact with the pressing force of the elastic member 172, it is possible to prevent the left/right adjustment 163 from rotating arbitrarily due to an external shock such as a gun firing.

The elastic force of the elastic member 172 for elastically supporting the pressure head 171 may be adjusted according to the distance between the adjustment screw 173 and the pressure head 171. Accordingly, when the elastic member 172 is elastically compressed through the adjustment screw 173 at the time when the zeroing adjustment is completed, it is possible to more effectively prevent the axial rotation position of the left/right adjustment 163 from being changed.

On the other hand, the pressure support unit 170 may also be applied to the upper/lower adjustment 165, and since it has the same structure as the pressure support unit 170 applied to the left/right adjustment unit 163, a description thereof is omitted.

The scope of the present invention is not limited to the above-described embodiments but may be implemented in various forms within the scope of the appended claims. Without departing from the gist of the present invention claimed in the claims, it is considered to be within the scope of the description of the claims of the present invention to various extents that can be modified by any person skilled in the art to which the invention pertains.

DESCRIPTION OF COMPONENTS OF EMBODIMENTS IN THE DRAWINGS

10: firearm,
11: seating groove, 11*a*: upper surface groove, 11*b*: side surface groove,
12: first groove,
13: first assembly groove,
14: second assembly groove,
20: body fastener,
21: fastening block,
22: insertion groove,
23: fastening ball,
24: first spring,
30: cover locking unit,
31: locking protrusion
32: locking block,
33: second spring,
100: dot sight,
110: body, 110*a*: protrusion, 110*b*: second recess groove,
111: first shaft insertion hole,
112: support,
113: pivot groove, 113*a*: connection passage, 113*b*: circular receiving groove,
114: receiving space, 114*a*: first shaft hole, 114*b*: second shaft hole, 114*c*: opening,
115: protective window,
116: illuminance sensor,
117: power supply,
118: wiring groove,
120: dot generator,
130: reflective mirror,
140: housing,
141: second axis insertion hole,
142*a*: first guide protrusion, 142*b*: second guide protrusion,
143: support surface,
144: connecting shaft,
145: first elastic member,
150: protective cover,
151: sidewall,
152: connecting bridge,
153: pivot shaft,
154: support wings,
155: sliding guide,
156: locking groove,
158: second elastic member,
159,159': stopper, 159*a*: first contact, 159*b*: second contact,
160: zeroing unit,
161: support body,
162: left/right movement block,
163: left/right adjust,
164: up/down movement block,
165: up/down adjustment,

166: spring,
167: fastening clip,
170: pressure support unit,
171: pressure head,
172: elastic member,
173: adjustment screw,
M1: permanent magnet,
M2: magnetic material,
RS: rear sight

What is claimed is:

1. A foldable dot sight device comprising:

a body capable of being assembled into a firearm;

a dot generator disposed on the body capable of generating a dot for aiming at a target; p1 a reflective mirror rotatably coupled to the body capable of transmitting an image of a target toward the user and capable of reflecting the dot generated by the dot generator;

a housing connected to the reflective mirror; and a protective cover including a sliding guide rotatably connected to the body and capable of rotating the housing in a folding or unfolding direction according to a rotational position, wherein the protective cover comprises an unfolding position set to a position where the sliding guide is separated from the housing by additional rotation of the protective cover after the housing is moved to the unfolded position.

2. A foldable dot sight device comprising:

a body capable of being assembled into a firearm;

a dot generator disposed on the body capable of generating a dot for aiming at a target;

a reflective mirror rotatably coupled to the body capable of transmitting an image of a target toward the user and capable of reflecting the dot generated by the dot generator;

a housing connected to the reflective mirror; and a protective cover including a sliding guide rotatably connected to the body and capable of rotating the housing in a folding or unfolding direction according to a rotational position, wherein the housing includes a first guide protrusion that is operable to be in contact with the sliding guide while the protective cover is rotating and is separated from the sliding guide after the protective cover is completely rotated in the unfolding direction.

3. The foldable dot sight device of claim 2, wherein the housing comprises a second guide protrusion that is operable to be pressed by the protective cover and enters the first guide protrusion into the sliding guide when the protective cover rotates in a folding direction from a fully unfolded state.

4. The foldable dot sight device of claim 1, wherein the protective cover comprises a rear sight capable of aligning with a front sight disposed in front of the barrel to aim at a target, and the rear sight is disposed in the aiming position when the protective cover rotated to the folded position.

5. A foldable dot sight device comprising:

a body capable of being assembled into a firearm;

a dot generator disposed on the body capable of generating a dot for aiming at a target;

a reflective mirror rotatably coupled to the body capable of transmitting an image of a target toward the user and capable of reflecting the dot generated by the dot generator;

a housing connected to the reflective mirror; and a protective cover including a sliding guide rotatably connected to the body and capable of rotating the housing in a folding or unfolding direction according to a rotational position, wherein the protective cover comprises a stopper that connects to the firearm, and wherein the stopper is capable of limiting additional rotation of the protective cover in the unfolding position of the protective cover.

6. A foldable dot sight device comprising:

a body capable of being assembled into a firearm;

a dot generator disposed on the body capable of generating a dot for aiming at a target;

a reflective mirror rotatably coupled to the body capable of transmitting an image of a target toward the user and capable of reflecting the dot generated by the dot generator;

a housing connected to the reflective mirror; and a protective cover including a sliding guide rotatably connected to the body and capable of rotating the housing in a folding or unfolding direction according to a rotational position, wherein the protective cover or the body comprises a stopper that guides the unfolding position of the protective cover, and wherein the stopper is provided in each of the body and the protective cover and comprises a permanent magnet and a magnetic body that is attached by magnetic force in the unfolded position of the protective cover.

7. The foldable dot sight device of claim 1, further comprising an elastic member for elastically supporting the protective cover in the unfolding direction.

8. The foldable dot sight device of claim 1, wherein the firearm comprises a cover locking unit capable of fixing the protective cover in a folded position.

9. A foldable dot sight device comprising:

a body capable of being assembled into a firearm;

a dot generator disposed on the body capable of generating a dot for aiming at a target;

a reflective mirror rotatably coupled to the body capable of transmitting an image of a target toward the user and capable of reflecting the dot generated by the dot generator;

a housing connected to the reflective mirror; and a protective cover including a sliding guide rotatably connected to the body and capable of rotating the housing in a folding or unfolding direction according to a rotational position, wherein the protective cover or the body comprises a stopper that guides the unfolding position of the protective cover, wherein the protective cover comprises sidewalls surrounding both sides of the body, a connecting bridge connecting the upper part of the sidewalls, a pair of pivot shafts respectively formed on inner side surfaces of each sidewall and facing each other, and a pair of pivot grooves formed on the body such that the pivot shafts are axially rotatably inserted and supported by the pivot grooves, and wherein each of the pair of pivot shafts comprises a pair of support wings extending in a radial direction from the outer circumferential surface, and the body comprises a connecting passage connecting the outer surface of the body and at least one of the pivot grooves so that the pivot shaft is capable of being inserted into the at least one pivot groove.

10. The foldable dot sight device of claim 9, wherein the body comprises circular receiving grooves so that each circular receiving groove is coaxial with each of the pivot grooves and capable of rotatably accommodating the pair of support wings.

11. The foldable dot sight device of claim 9, wherein an outer edge of the pair of support wings forms a circular arc corresponding to the inner circumferential surface of the circular receiving grooves.

12. A foldable dot sight device comprising:

a body capable of being assembled into a firearm;

a dot generator disposed on the body capable of generating a dot for aiming at a target;

a reflective mirror capable of transmitting an image of a target toward the user and capable of reflecting the dot generated by the dot generator;

a housing connected to the reflective mirror; and a protective cover including a sliding guide rotatably connected to the body, wherein the housing includes a first guide protrusion that is operable to be in contact with the sliding guide while the protective cover is rotating and is separated from the sliding guide after the protective cover is completely rotated in the unfolding direction, and wherein the housing comprises a second guide protrusion that is operable to be pressed by the protective cover and enters the first guide protrusion into the sliding guide when the protective cover rotates in a folding direction from a fully unfolded state.

13. The foldable dot sight device of claim 12, wherein the body comprises a support for guiding an unfolding position of the housing, and the housing is elastically supported in an unfolding direction by an elastic member.

14. The foldable dot sight device of claim 13, wherein the support comprises a permanent magnet being disposed on the support, and a magnetic body capable of being attached to the permanent magnet is provided at a position corresponding to the permanent magnet of the housing.

15. The foldable dot sight device of claim 12, wherein the body comprises a zeroing unit disposed inside the protective cover on the body, and the zeroing unit is capable of adjusting the position of the dot generator left and right and up and down.

16. The foldable dot sight device of claim 15, wherein the zeroing unit comprises a support for supporting the dot generator, a left/right moving block vertically and slidably assembled to the support, a left/right adjustment unit axially and rotatably supported on the body, an up/down moving block laterally and slidably assembled to the support, and an up/down adjustment unit is axially and rotatably supported on the body.

17. The foldable dot sight device of claim 16, wherein the zeroing unit further includes a spring that is disposed between the body and the up/down moving block such that the spring elastically supports the up/down moving block in an upward or downward direction.

18. The foldable dot sight device of claim 16, wherein the zeroing unit comprises a pressure support unit for preventing rotation of the left /right adjustment unit or the up/down adjustment unit.

19. The foldable dot sight device of claim 16, wherein the protective cover comprises a sidewall provided with a through-hole through which the left /right adjustment unit is exposed when the protective cover is fully unfolded.

20. The foldable dot sight device of claim 18, wherein the pressure support unit comprises a pressure head disposed on the side of the left/right adjustment unit or up/down adjustment unit, an elastic member elastically supporting the pressure head, and an adjustment screw screwed to the body that is capable of supporting the rear portion of the elastic member.

21. The foldable dot sight device of claim 12, wherein the body is detachably assembled in a seating groove provided on the firearm.

22. The foldable dot sight device of claim 21, wherein the firearm is provided with a body fastener for fastening the body assembled in the seating groove.

23. The foldable dot sight device of claim 22, wherein the body fastener comprises a fastening block assembled in a direction crossing the firearm in the side surface groove, and the body is engaged with the fastening block to limit movement in the upward direction.

24. The foldable dot sight device of claim 23, wherein the body fastener includes a fastening ball in contact with the side surface of the fastening block, and the fastening ball includes a spring for elastically supporting the fastening ball toward the fastening block, and an insertion groove disposed on the side of the fastening block such that the fastening ball can be inserted and supported.

25. A foldable dot sight device comprising:

a body capable of being assembled into a firearm;

a dot generator disposed on the body capable of generating a dot for aiming at a target;

a reflective mirror rotatably coupled to the body capable of transmitting an image of a target toward the user and capable of reflecting the dot generated by the dot generator;

a housing connected to the reflective mirror; and a protective cover including at least one stopper capable of guiding an unfolding movement of the protective cover by restricting additional rotation when the protective cover is in an unfolded position, wherein the at least one stopper comprises a first stopper having a first contact element disposed on the side of the body and a second contact element being disposed on the protective cover.

26. The foldable dot sight device of claim 25, wherein the first contact element and the second contact element come in contact vertically to fix and maintain the unfolded position of the protective cover.

27. The foldable dot sight device of claim 25, wherein the at least one stopper comprises a second stopper having a fixing hole being disposed on a lower part of the pivot axis of the protective cover and a fixing ball and an elastic element being disposed on the side of the body.

28. The foldable dot sight device of claim 27, wherein the fixing ball is inserted into the fixing hole by the elasticity of the elastic element such that the unfolding position of the protective cover is fixed.

29. The foldable dot sight device of claim 27, wherein the at least one stopper comprises a plurality of stoppers being combined to reinforce or increase the fixing strength of the unfolding position of the protective cover.

* * * * *